US007434773B1

(12) United States Patent
Minjares

(10) Patent No.: US 7,434,773 B1
(45) Date of Patent: Oct. 14, 2008

(54) ADJUSTABLE SUPPORT FOR ARCHERY BOWS AND THE LIKE

(76) Inventor: Rory Minjares, 10090 Highway 10 East, Missoula, MT (US) 59802

( * ) Notice: Subject to any disclaimer, the term of this patent is extended or adjusted under 35 U.S.C. 154(b) by 91 days.

(21) Appl. No.: 11/388,559

(22) Filed: Mar. 24, 2006

Related U.S. Application Data

(60) Provisional application No. 60/665,244, filed on Mar. 24, 2005.

(51) Int. Cl.
*F16M 11/02* (2006.01)

(52) U.S. Cl. ..... 248/181.1; 42/94 R; 124/86

(58) Field of Classification Search ..... 248/181.1, 248/181.2, 187.7, 149, 161, 163.2, 176.1, 248/177.1; 124/86; 42/94
See application file for complete search history.

(56) References Cited

U.S. PATENT DOCUMENTS

| | | | | | |
|---|---|---|---|---|---|
| 2,859,059 | A | * | 11/1958 | De Loach et al. | 403/103 |
| 4,290,207 | A | * | 9/1981 | Browning et al. | 33/295 |
| 4,474,296 | A | | 10/1984 | Hartman | |
| 4,674,472 | A | | 6/1987 | Reis | |
| 4,936,283 | A | | 6/1990 | Izuta | |
| 4,993,398 | A | | 2/1991 | Wallace | |
| 5,205,272 | A | | 4/1993 | Boyer | |
| 5,345,706 | A | * | 9/1994 | Brown | 42/94 |
| 5,487,374 | A | | 1/1996 | Herminath et al. | |
| 5,509,400 | A | | 4/1996 | Chalin | |
| 5,547,162 | A | | 8/1996 | Sobolewski et al. | |
| 6,029,643 | A | | 2/2000 | Golfieri | |
| 6,070,569 | A | * | 6/2000 | Chalin et al. | 124/86 |
| 6,205,992 | B1 | | 3/2001 | Meeks et al. | |
| 6,425,765 | B1 | | 7/2002 | Irwin, III | |
| 6,526,957 | B1 | * | 3/2003 | Leven | 124/89 |
| 6,712,059 | B2 | | 3/2004 | Donovan | |
| 6,720,491 | B1 | * | 4/2004 | Kroncke | 84/422.3 |
| 7,047,960 | B2 | * | 5/2006 | McCrea | 124/86 |
| 2002/0066446 | A1 | | 6/2002 | Kesti | |
| 2004/0160523 | A1 | * | 8/2004 | Mogi et al. | 348/333.07 |

* cited by examiner

*Primary Examiner*—Ramon O Ramirez
(74) *Attorney, Agent, or Firm*—Shane P. Coleman; Holland & Hart LLP

(57) ABSTRACT

An apparatus is provided including a shaft, a head connected to the shaft, and a connector capable of connecting the head to a supported object, such as an archery bow. The head is connected to the shaft to allow pivoting movement between the shaft and the head at a joint in pivotally in three dimensions. In one embodiment, the connector further includes a vibration and noise damper with a magnetic connection adapted to releaseably connect to the head. The connection between the head and the connector may allow axial rotation there between. A brake assembly controls extension of the shaft.

27 Claims, 29 Drawing Sheets

A
51
52
33
31
10
14
41
42
43
32
34
30
16
12
Z
X

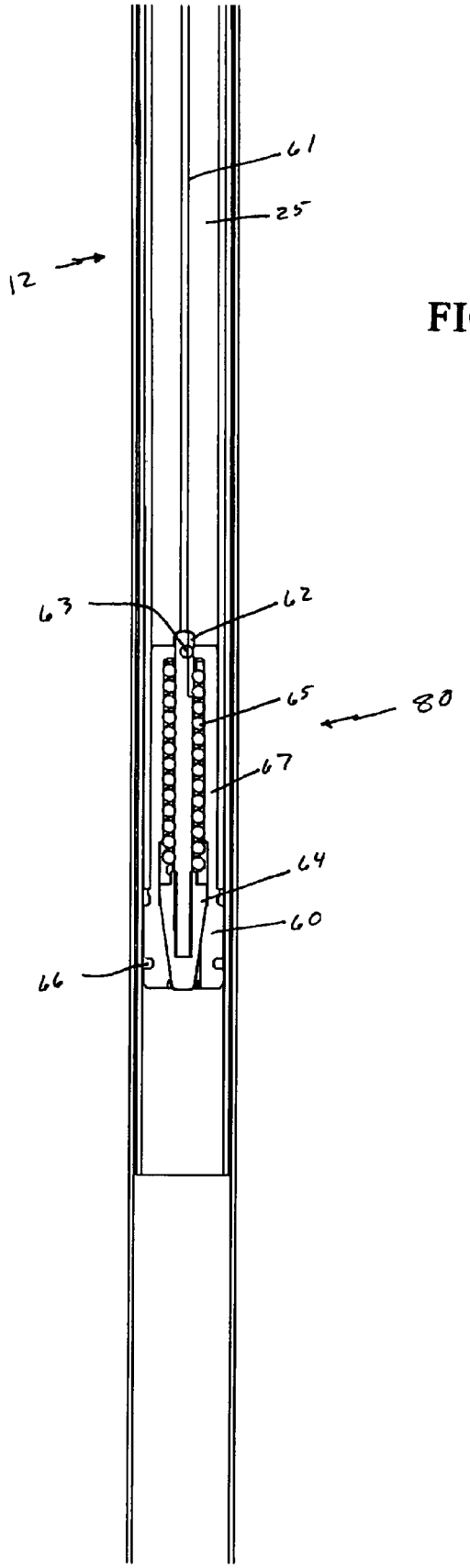
FIG. 17
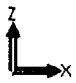

ADJUSTABLE SUPPORT FOR ARCHERY BOWS AND THE LIKE

PRIORITY CLAIM

This application claims the benefit of the filing date of U.S. provisional patent application No. 60/665,244 filed Mar. 24, 2005, entitled "ADJUSTABLE SUPPORT FOR ARCHERY BOWS AND THE LIKE," which is hereby incorporated in its entirety by this reference.

FIELD OF INVENTION

The present invention relates to an apparatus for supporting devices such as archery bows, cameras, spotting scopes. More particularly, the present invention relates to a detachable, adjustable monopod support.

BACKGROUND

In the field of archery, various devices are known for supporting a bow while the user aims and shoots the arrow from the bow. Supports are used, for example, by beginning, elderly, or disabled shooters; by advanced shooters to sight the bow during practice; by competition shooters; and by shooters who are practicing technique.

Conventional support systems have various shortcomings. Such systems do not quickly or easily adjust to different users, different terrain, or different shooting orientations. For example, a user may be running across hilly or rocky terrain, and during that run may want the support system in a compact position, but may then want to quickly deploy the support to take aim at a target. Also, existing systems do not easily allow the user to make fine adjustments of the support to accommodate different shooting positions or orientations. Also, it is desirable for the support to quickly detach from the bow, for example, if the user must run to chase a moving target. Existing systems are cumbersome to set up, adjust, retract, and detach from the bow. The same problems affect users of other supported field devices, such as spotting scopes, binoculars, still and video cameras, firearms, transits, and the like.

SUMMARY OF THE INVENTION

There exists a need to provide an improved support arrangement which overcomes at least some of the above-referenced deficiencies. Accordingly, at least this and other needs have been addressed by exemplary embodiments of the apparatus according to the present invention. One such embodiment is directed to an apparatus including a shaft, a head connected to the shaft, and a connector capable of connecting the head to a supported object, such as an archery bow. The head is connected to the shaft to allow pivoting movement between the shaft and the head at a joint in a range of 360 degrees.

In another exemplary embodiment, an apparatus is provided having a first portion with a first end having a bow connector adapted to connect to an archery bow and a second portion pivotally connected to the first portion at an axial connection. The axial connection allows movement along an axis between the first and second portions. The apparatus further includes a shaft depending from the second portion.

In yet another exemplary embodiment of the present invention, an apparatus is provided having means for supporting a supported object, such as an archery bow, binoculars, a spotting scope, a firearm, a transit, etc. The apparatus further includes a means of connecting to the supported object. In the example of an archery bow, the means of connecting includes, for example, a threaded means of connecting to a universal bow connection. The apparatus further includes a means for releasably connecting the supporting means to the means for connecting to the supporting object.

BRIEF DESCRIPTION OF DRAWINGS

The detailed description will refer to the following drawings, wherein like numerals refer to like elements, and wherein:

FIG. 17 shows a cross-section of an exemplary embodiment of a brake arrangement disposed within the hollow portion of the shaft;

DETAILED DESCRIPTION

Figure 1:
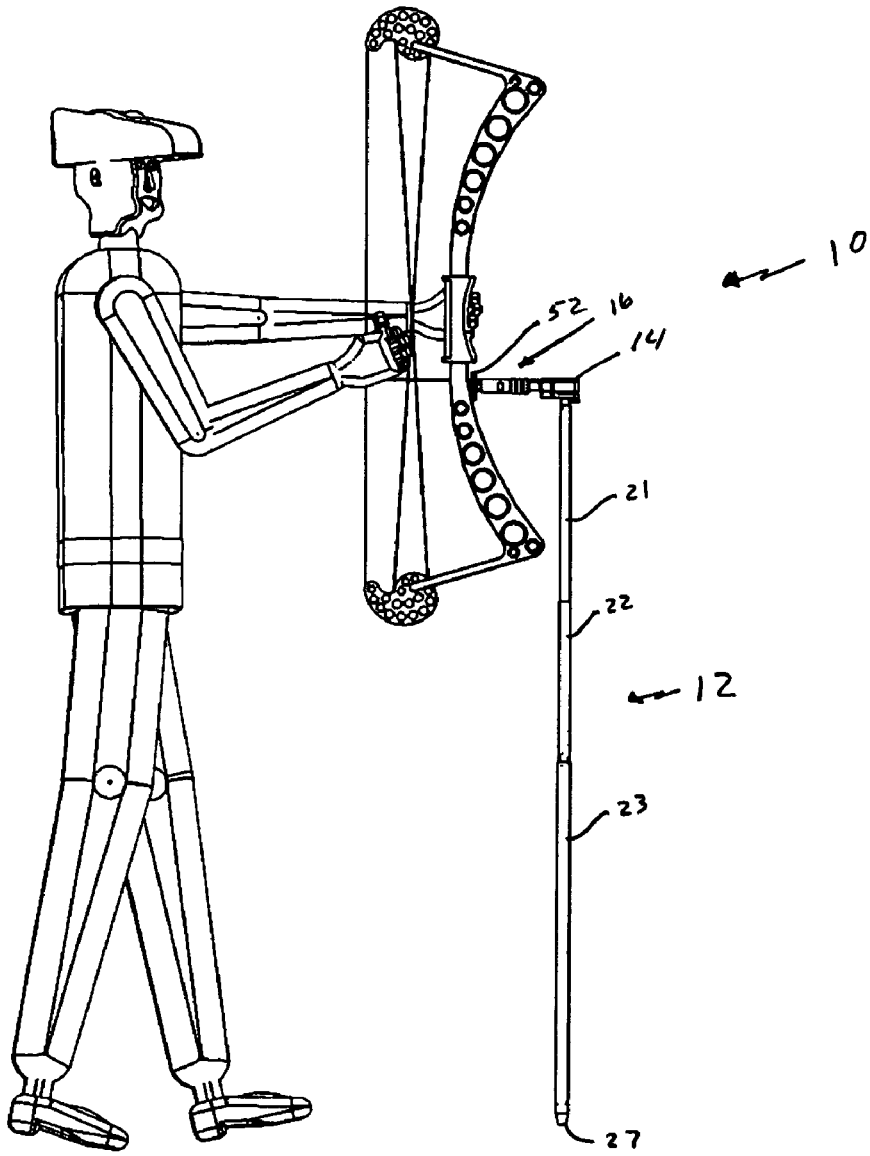
FIG. 1 shows a perspective view of an exemplary embodiment of the apparatus connected to an archery bow in use by a person.

FIG. 1 shows a perspective view of an exemplary embodiment of the apparatus 10 connected to an archery bow in use by a person. The shaft 12 is extended to the ground to provide stability and shock absorption during shooting. The shaft 12 is connected to a head 14, which in turn is connected to the bow at a bow connector 16. The bow connector 16 is any connector that can connect it to a universal connector of a riser portion of an archery bow, or to any other device.

As described further herein, in the embodiment shown, the bow connector 16 includes a connection end (51 in FIG. 8) that attaches directly to the bow. In one exemplary embodiment, the connection end (51 in FIG. 8) includes threads adapted to connect to a universal bow connector, such as a threaded connection of a bow that is adapted to receive a conventional shock absorber, stabilizer, vibration damper, or other similar accessory. The bow connector 16 further includes a lock 52, such as a lock nut knob, that secures the connection end (51 in FIG. 8) to the bow (or other supported device).

Figure 7:
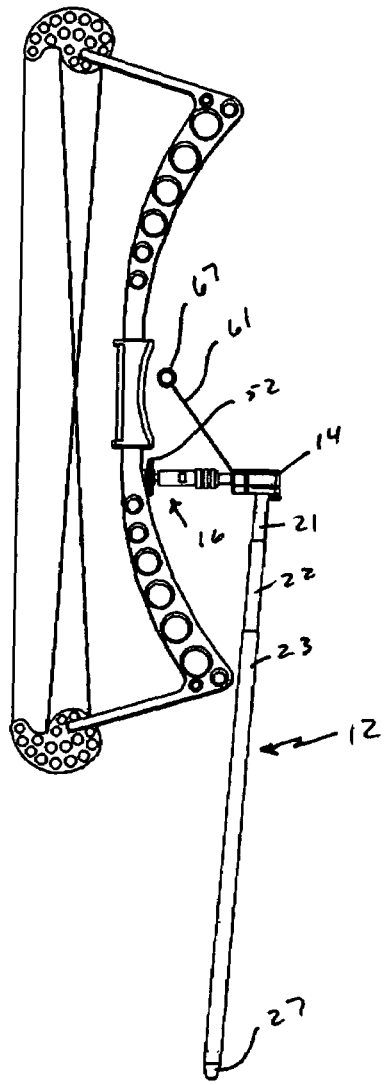
FIG. 7 shows a side view of the apparatus connected to a bow.
Figure 7:
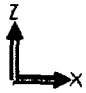

In the embodiment shown in FIG. 1, the shaft 12 is a telescoping shaft that adjusts in length. The shaft 12 includes three telescoping portions 21, 22, 23. In one embodiment, the shaft 12 adjusts with a brake arrangement (not shown in FIG. 1). The brake arrangement may be accessed conveniently while the user is holding the bow, with an arrow drawn. FIG. 7 shows a side view of the apparatus 10 connected to a bow. In this exemplary embodiment, the brake arrangement (not shown) is positioned inside the shaft 12 and is operated by a control, such as an O-ring 67 connected to a string 61 that is in turn connected to the brake arrangement (not shown). The O-ring 67 may be positioned near the user's hand that holds the bow during use. With the bow positioned generally at a pre-selected height from ground, the user applies tension to the string 61 to release the brake arrangement thereby allowing the shaft 12 to extend until reaching the ground. With the shaft 12 in the desired position, the user releases the string 61 to return the brake arrangement to a locked position, in this embodiment, and the length of the shaft 12 is set. The shaft 12 may be retracted or otherwise adjusted by again using the brake arrangement.

Figure 3:
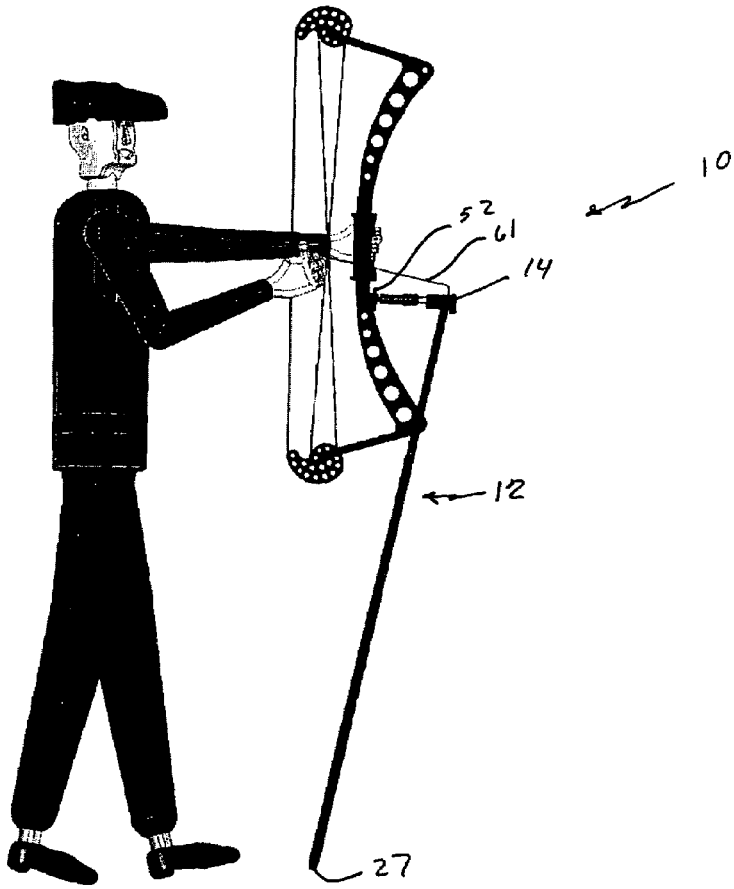
FIG. 3 shows a perspective view of the apparatus shown in FIGS. 1 and 2, with the shaft angling toward the user.
Figure 3:
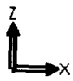
Figure 4:
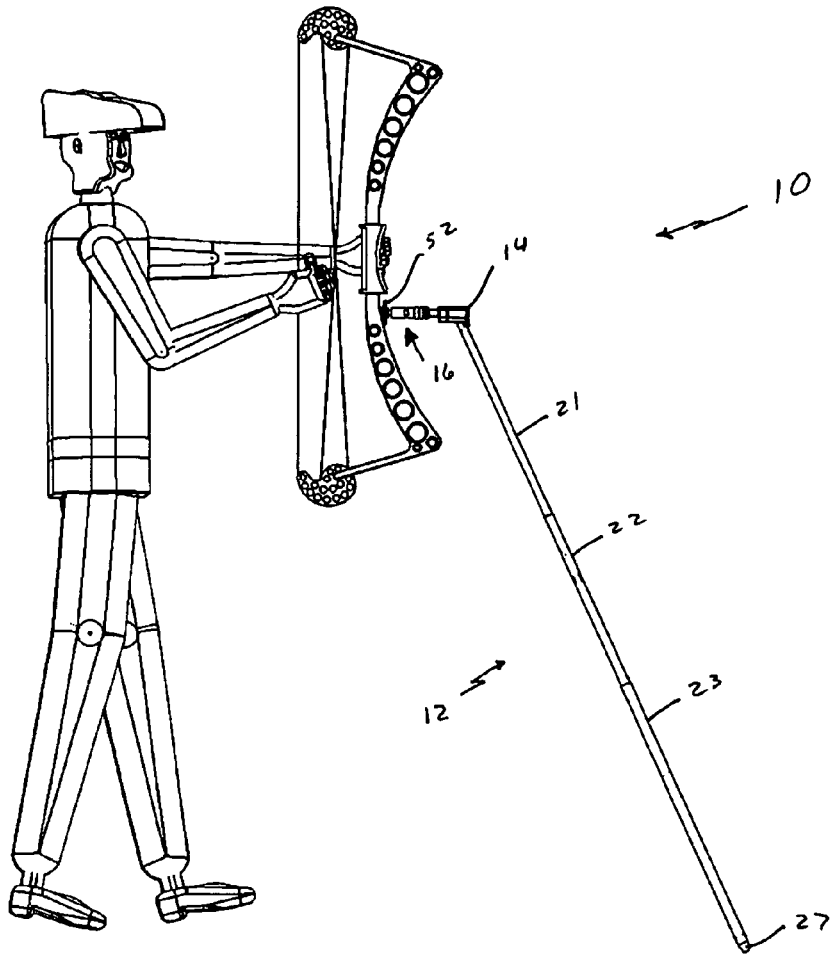
FIG. 4 shows a perspective view at the apparatus with the shaft angling away from the user.
Figure 4:
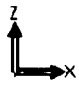
Figure 5:
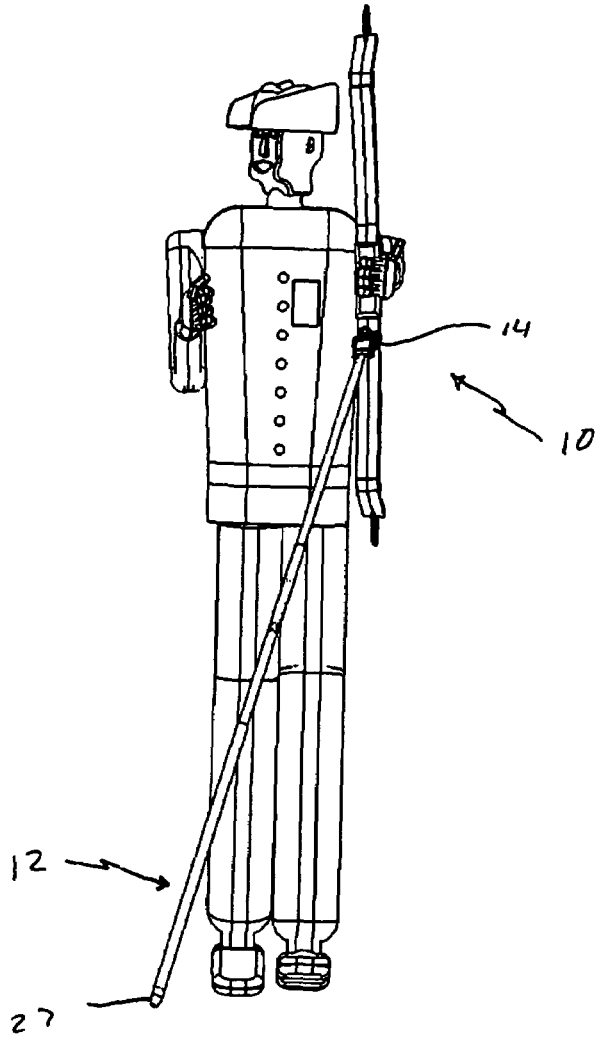
FIG. 5 shows a perspective view of the shaft angling toward the user's right side.
Figure 5:
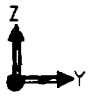

In one exemplary embodiment, the shaft 12 is allowed to move pivotally in three dimensions at the connection to the head 14. This allows the user to adjust the orientation of the bow, as needed during shooting, particularly on uneven terrain. The movement may be obtained, for example, by using a ball joint (20 in FIG. 8) at the connection between the shaft 12 and the head 14. For example, FIG. 3 shows a perspective view of the apparatus 10 shown in FIG. 1, with the shaft angling toward the user. FIG. 4 shows a perspective view at the apparatus 10 with the shaft angling away from the user. FIG. 5 shows a perspective view of the shaft angling toward the user's right side. Once the shaft 12 is in the desired position relative to the head 14, a joint control (not shown in FIG. 1) may be used to limit movement of the shaft 12 about the head 14. In one embodiment, a ball joint (20 in FIG. 8) is used to connect the shaft 12 to the head 14, and the joint control includes one or more screws that adjust tension of the head 14 on the ball (20 in FIG. 8).

In one exemplary embodiment, the head 14 pivotally connects to the bow connector 16 such that the head 14 may move axially relative to the bow connector 16 along an axis between the bow connector 16 and the head 14. In this embodiment, even when the joint control of the ball joint has fixed the position of the head 14 relative to the shaft 12, the bow connector 16 (and thus, the bow) may still move axially relative to the head 14 and the shaft 12 to further adjust the aim of the bow. In another embodiment, a key arrangement or other structure limits or prevents axial movement between the bow connector 16 and the head 14.

Figure 8:
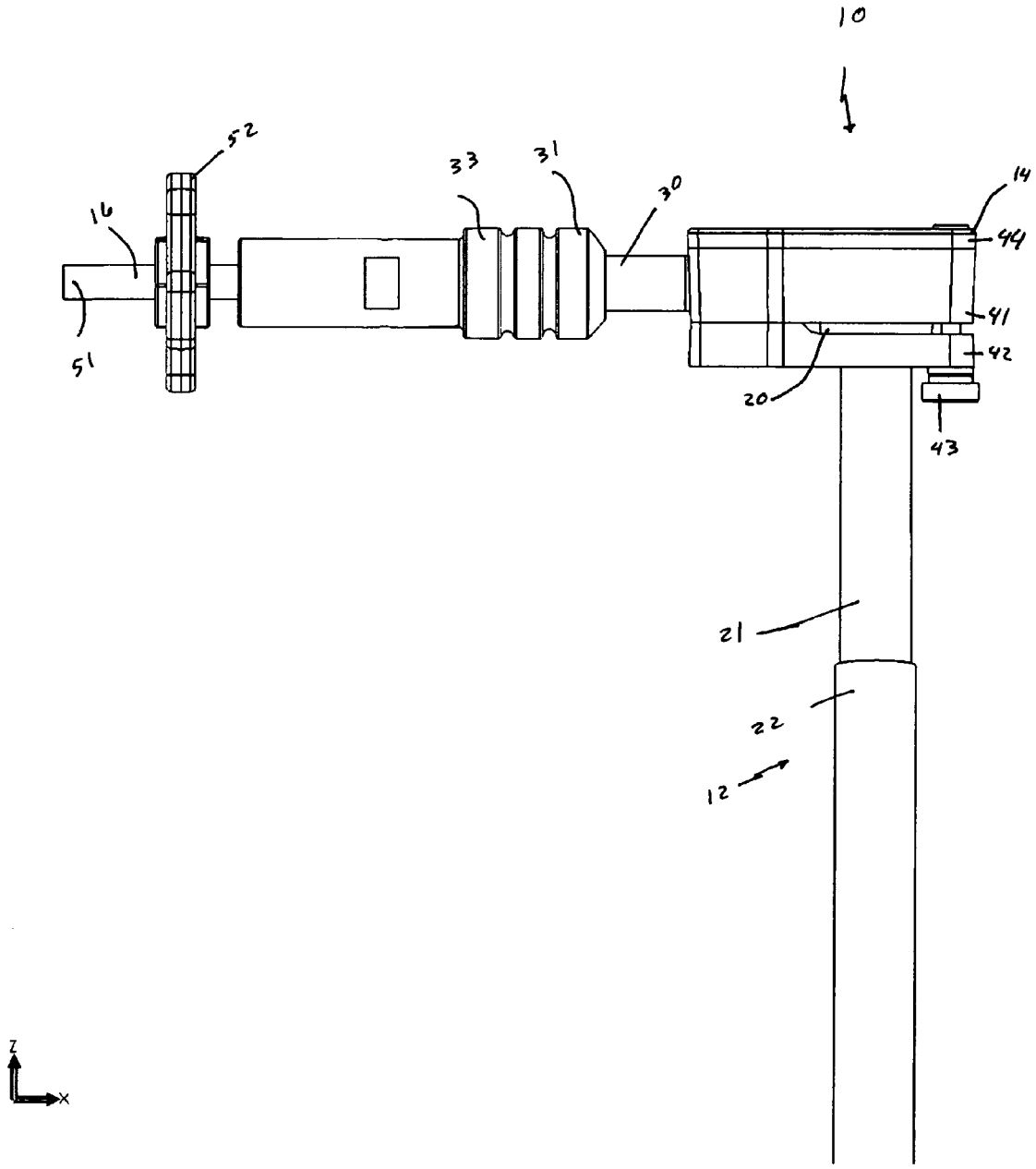
FIG. 8 shows a more detailed side view of an upper portion of the apparatus.

FIG. 8 shows a more detailed side view of an upper portion of the apparatus 10. In this exemplary embodiment, the head 14 releasably connects to the bow connection 16. This may be embodied, for example, in a magnetic connection. In one exemplary embodiment, the head 14 includes a metal male connector 30 that releasably connects to a female connector 31 of the bow connector 16. A magnet (now shown) is connected to either the female connector 31 or the male connector 30, or both, and holds the male and female connectors 30, 31 together. In one embodiment, the male and female connectors 30, 31 are cylindrical and allow the axial movement of the head 14 relative to the bow connector 16. In another embodiment, the male and female connectors 30, 31 fit together with a key arrangement that prevents or limits axial movement therebetween.

In the embodiment shown in FIG. 8, the bow connector 16 of the apparatus 10 further includes a damper 33 to dampen vibration and noise from the bow. In one embodiment, the damper 33 includes the female connector 31 with the magnet (not shown) to create a quick release of the shaft 12 from the bow. In this embodiment, the head 14 and shaft 12 may be detached from the apparatus 10, and the bow connector 16 with the damper 33 may be used alone.

Figure 2:
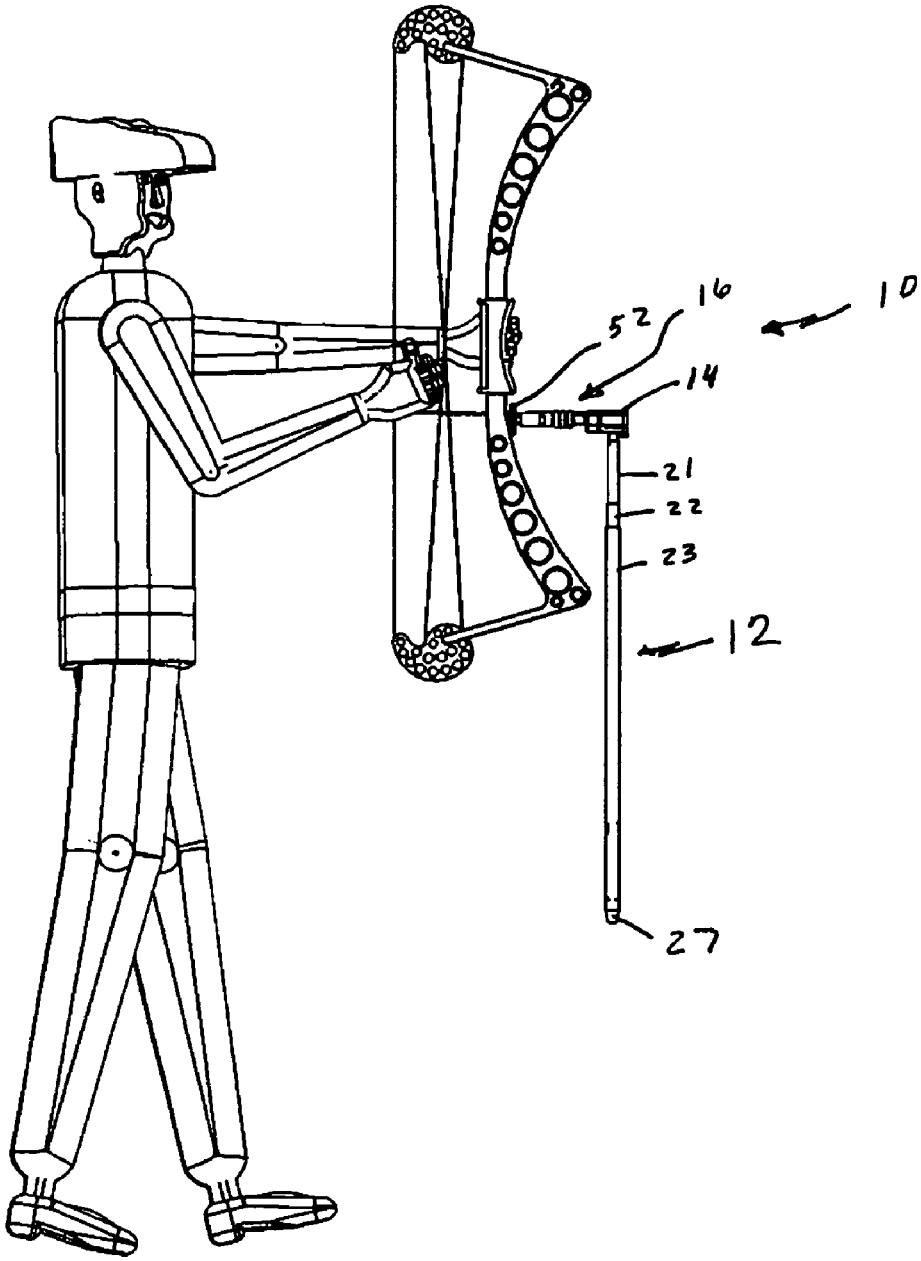
FIG. 2 shows a perspective view of the apparatus shown in FIG. 1, with the shaft in a retracted position.
Figure 6:
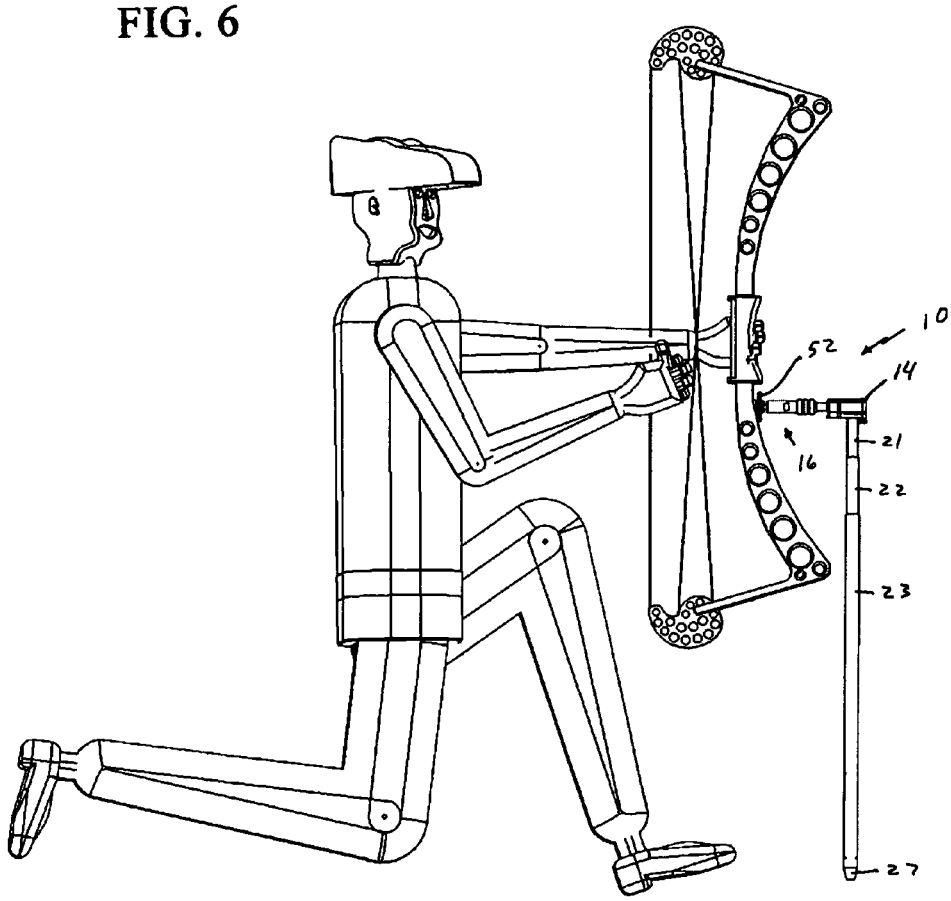
FIG. 6 shows a perspective view of the apparatus with the shaft in a retracted position to accommodate a kneeling user.
Figure 6:
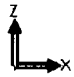

In use, the user may carry the bow with the shaft 12 in a retracted position for easier carrying. FIG. 2 shows a perspective view of the apparatus 10 shown in FIG. 1, with the shaft 20 in a retracted position. Upon reaching a shooting point, the user activates the brake control (not shown) to extend the shaft 12 to the desired length, based upon the terrain, the shooter's position and orientation, etc. With the shaft 12 supporting the bow by contacting the ground with the ground rest 27 as shown in FIG. 1, the user may adjust the position of the shaft 12 relative to the head 14, about a 360-degree range, and may lock the position of the shaft 12 relative to the head 14 using the joint control. With the joint control locked, the user may move the bow (and the bow connector 16) in a limited manner, axially. With the bow in position, the user may then shoot an arrow (or otherwise operate a different supported device). To retract the shaft 12, the user activates the brake control to allow the shaft to change to a shortened length. Regardless of the position of the shaft 12, the user may detach the shaft 12 from the bow at the connection between the bow connector 16 and the head 14, for example, by pulling the magnetic male and female connectors (not shown) apart from each other. Using the brake control (not shown) the user may at any time retract the shaft 12. For example, FIG. 6 shows a perspective view of the apparatus 10 with the shaft 12 in a retracted position to accommodate a kneeling user.

The embodiment of FIG. 8 attaches to a riser section of a bow at a threaded end 51 of the bow connector 16. The lock 52 secures the apparatus 10 to the bow. In the embodiment shown, the head 14 includes an upper portion 44, a mid portion 41, and a lower portion 42. The head 14 connects to the shaft 12 at a ball joint. The ball joint includes a ball 20 connected to an upper portion of the shaft 21. The ball 20 is disposed within the head 14. One or more screws 43 urge the lower portion 42 of the head 14 to the mid portion 41 to thereby tighten the head 14 around the ball 20, and thereby lock the shaft 12 into place. The screws 43 act as the joint control in the embodiment of FIG. 8.

Figure 9:
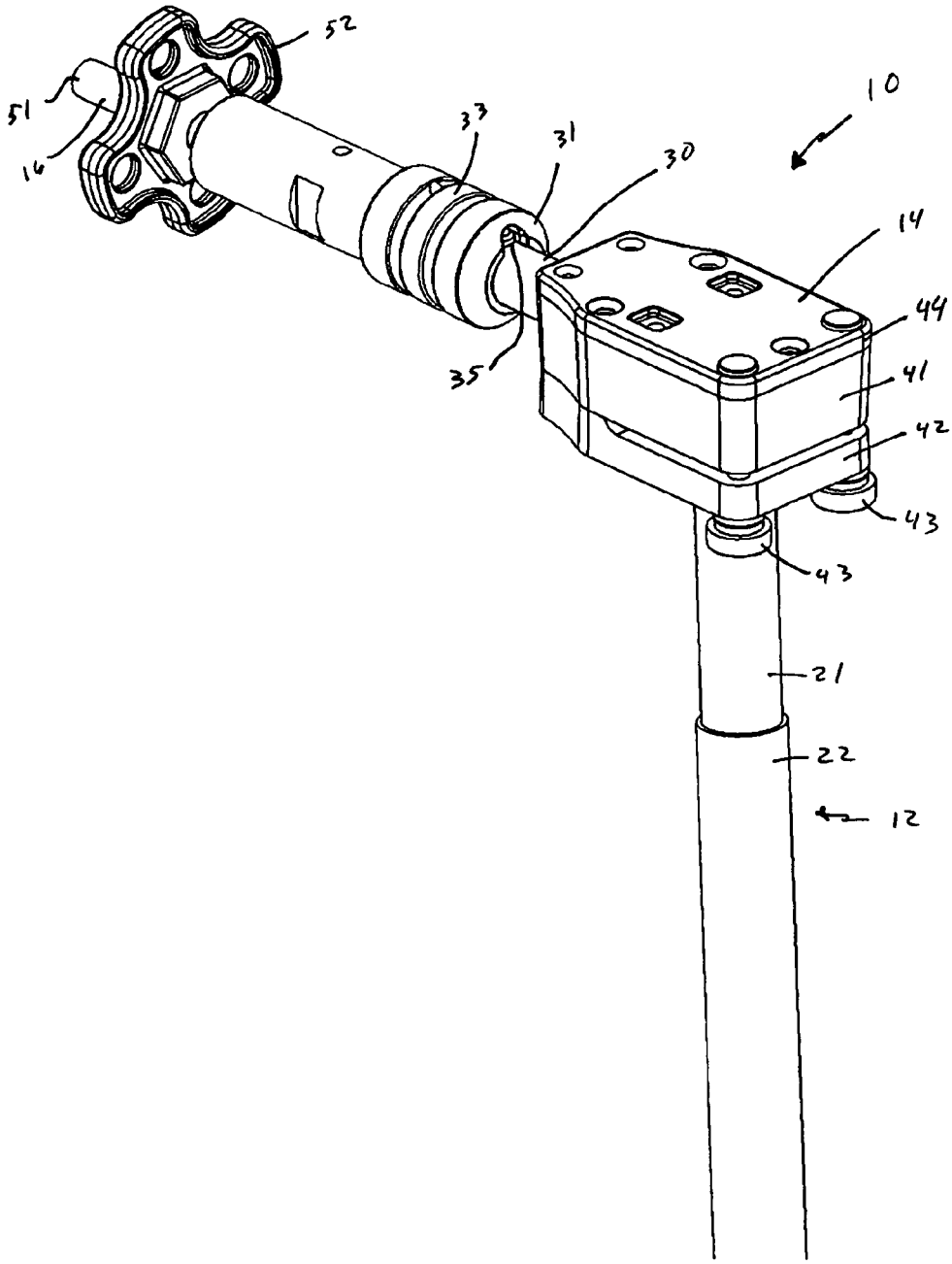
FIG. 9 shows a perspective view of the upper portion of one embodiment of the apparatus shown in FIG. 8.
Figure 9:
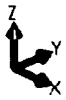
Figure 10:
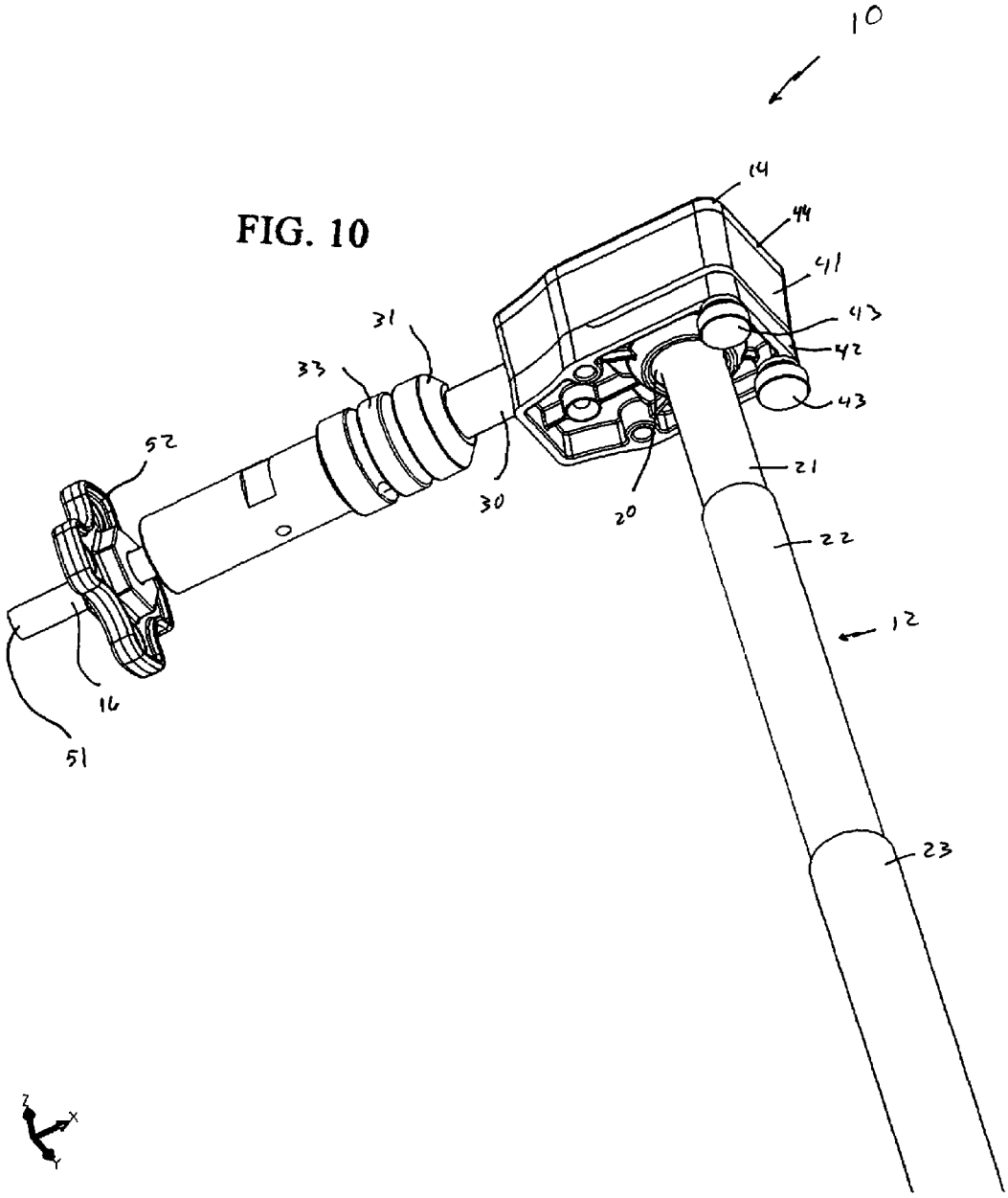
FIG. 10 shows another perspective view of the upper portion of the apparatus.

FIG. 9 shows a perspective view of the upper portion of one embodiment of the apparatus 10 shown in FIG. 8. The embodiment of FIG. 9 includes two separate screws 43 for locking the ball joint. Also, this embodiment of the apparatus 10 includes a key arrangement for connecting the head 14 to the bow connector 16. In particular, a key 35 positioned on the male connector 30 is received in a suitable slot in the female connector 31. FIG. 10 shows another perspective view of the upper portion of the apparatus 14. FIG. 10 more particularly shows one embodiment of the position of the screws 43 and the ball 20. When tightened, the screws 43 urge the lower portion 42 of the head 14 toward the mid-portion 41 and thereby tighten the head 14 against the ball 20.

Figure 11:
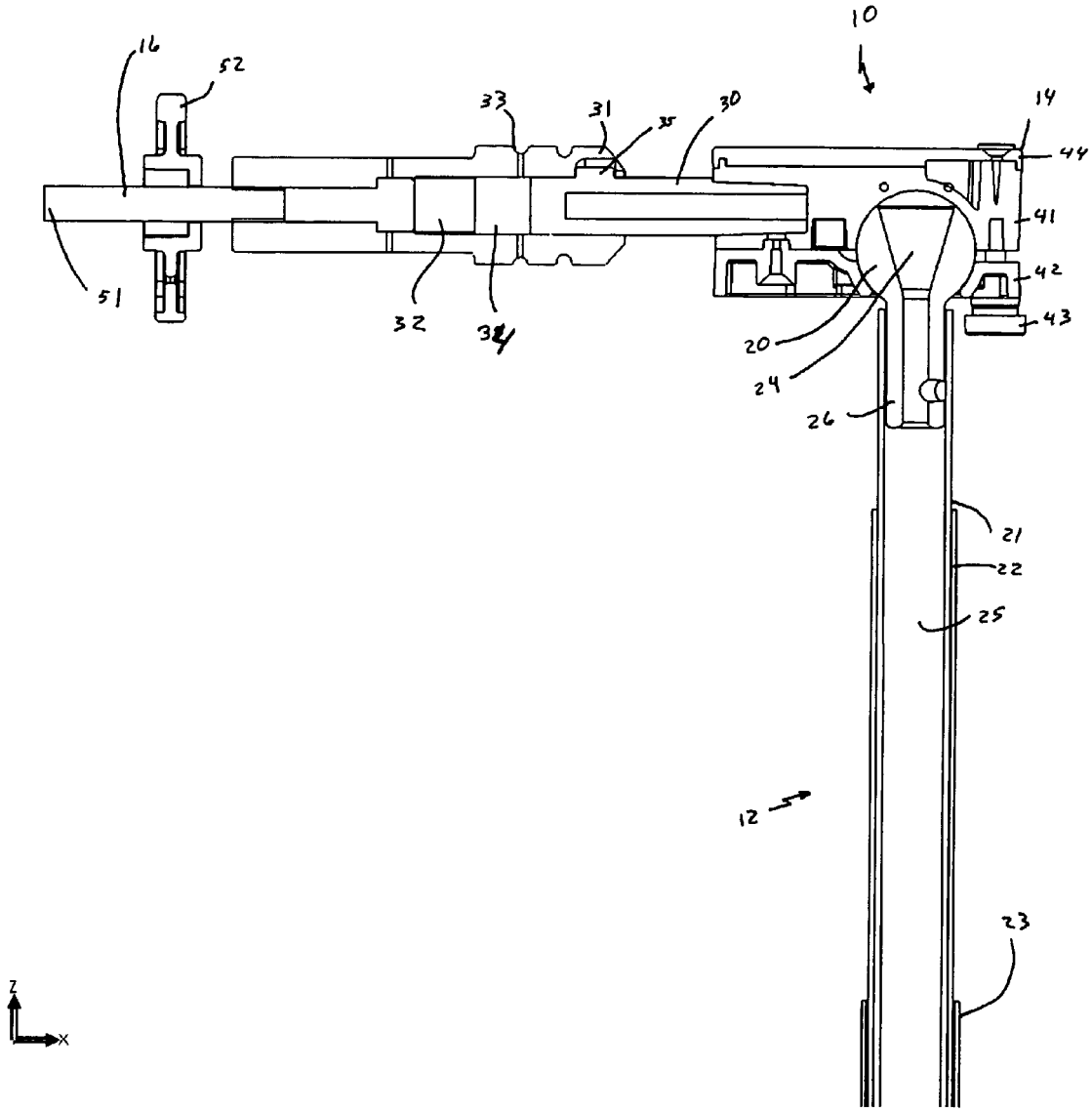
FIG. 11 shows a cross-section of the apparatus shown in FIGS. 9-10.

FIG. 11 shows a cross-section of the apparatus 10 shown in FIGS. 9-10. As shown in the exemplary embodiment of FIG. 11, the ball 20 has an extended portion 26 that is connected to an upper segment 21 of the telescoping shaft 12 at the ball joint with the head 14. The shaft 12 has a hollow portion 25 in this embodiment. The ball 20 and extended portion 26 include a cavity 24 that connects to the hollow portion 25 of the shaft 12. A string, wire, or similar device (61 in FIG. 14) passes through the hollow portion 25 of the shaft 12 and through the cavity 24 of the ball 20, and controls the brake arrangement (now shown) in this embodiment. The female connector 31 defines a cavity 34 that receives the male connector 30. A magnet 32 is positioned in the cavity 34 to detachably hold the male and female connectors 30, 31 together.

Figure 12:
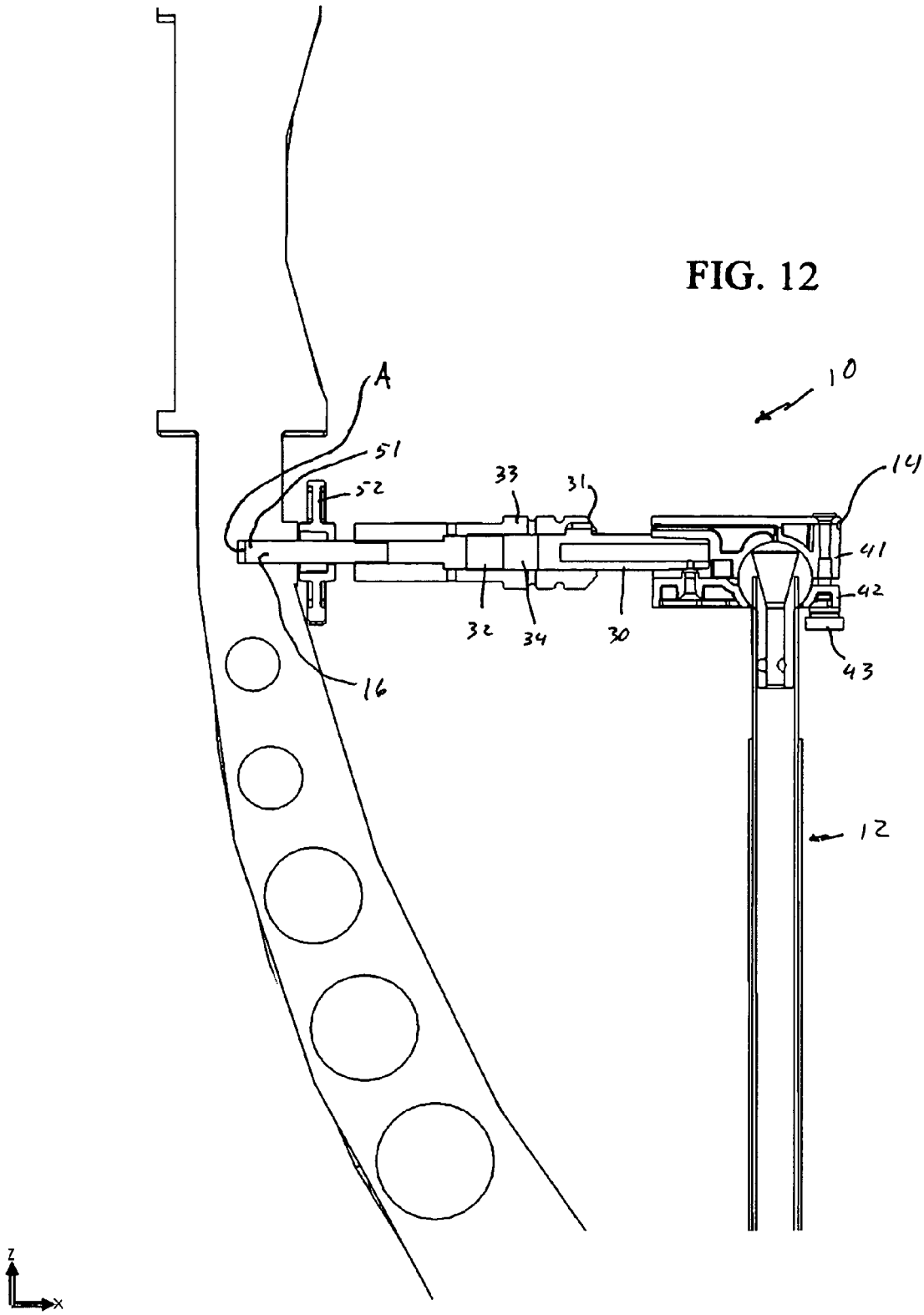
FIG. 12 shows a cross-section view of the apparatus.

FIG. 12 shows a cross-section view of the apparatus 10. In the embodiment shown in FIG. 12, the bow connection 16 is connected to a universal connector A of an archery bow. The universal connector A receives the threaded end 51 of the bow connection 16. The lock 52 helps secure the threaded end 51 in the universal connector A.

Figure 13:
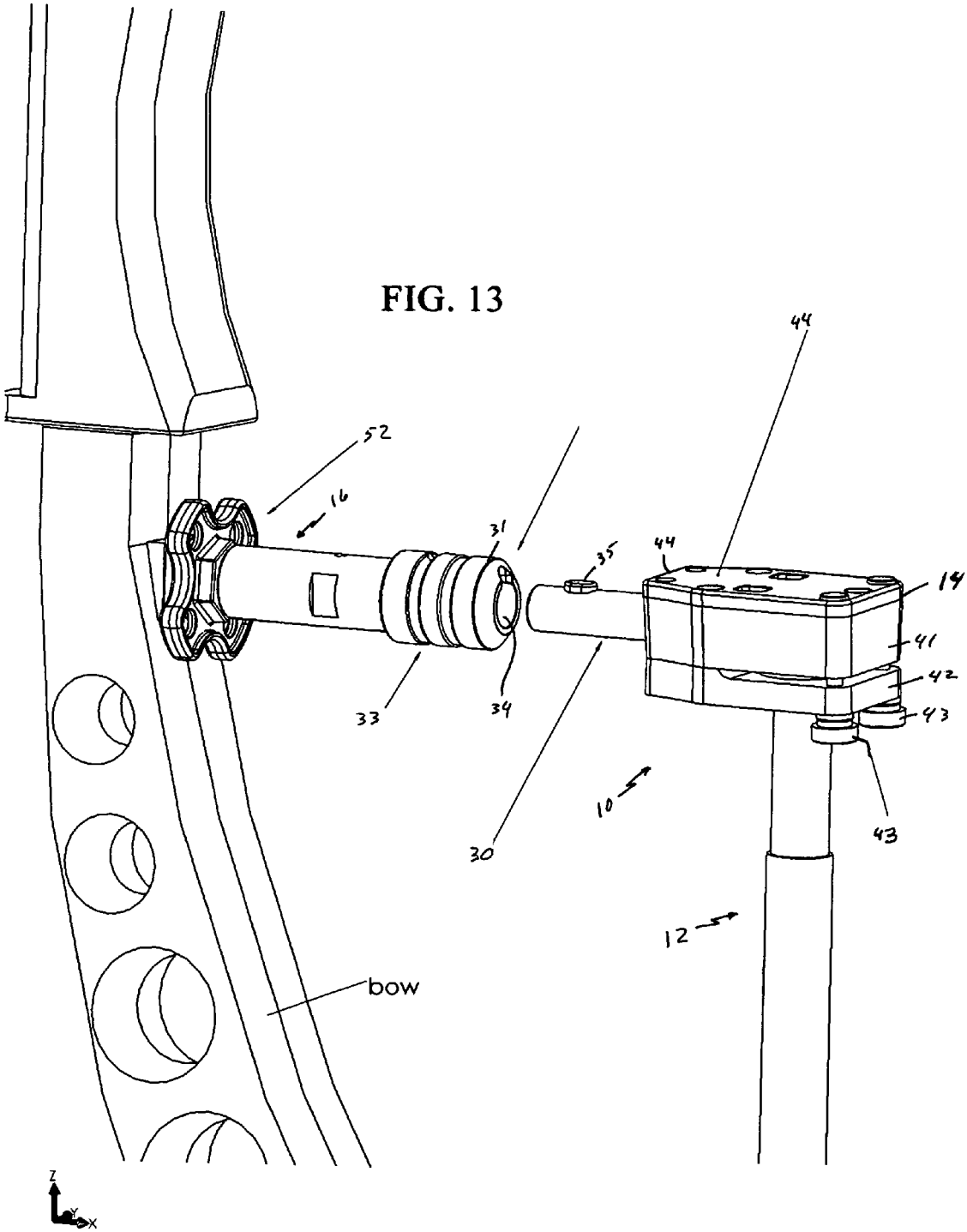
FIG. 13 shows a perspective view illustrating the release mechanism of the head and the bow connector.

FIG. 13 shows a perspective view illustrating the release mechanism between the head 14 and the bow connector 16. As shown, the male connector 30 may be removed from the female connector 31, leaving the bow connector 16 still attached to the archery bow or other device. A magnetic connection may be used to connect the male and female connectors 30, 31, to enable the connectors 30, 31 to remain solidly connected yet quickly release as needed.

Figure 14:
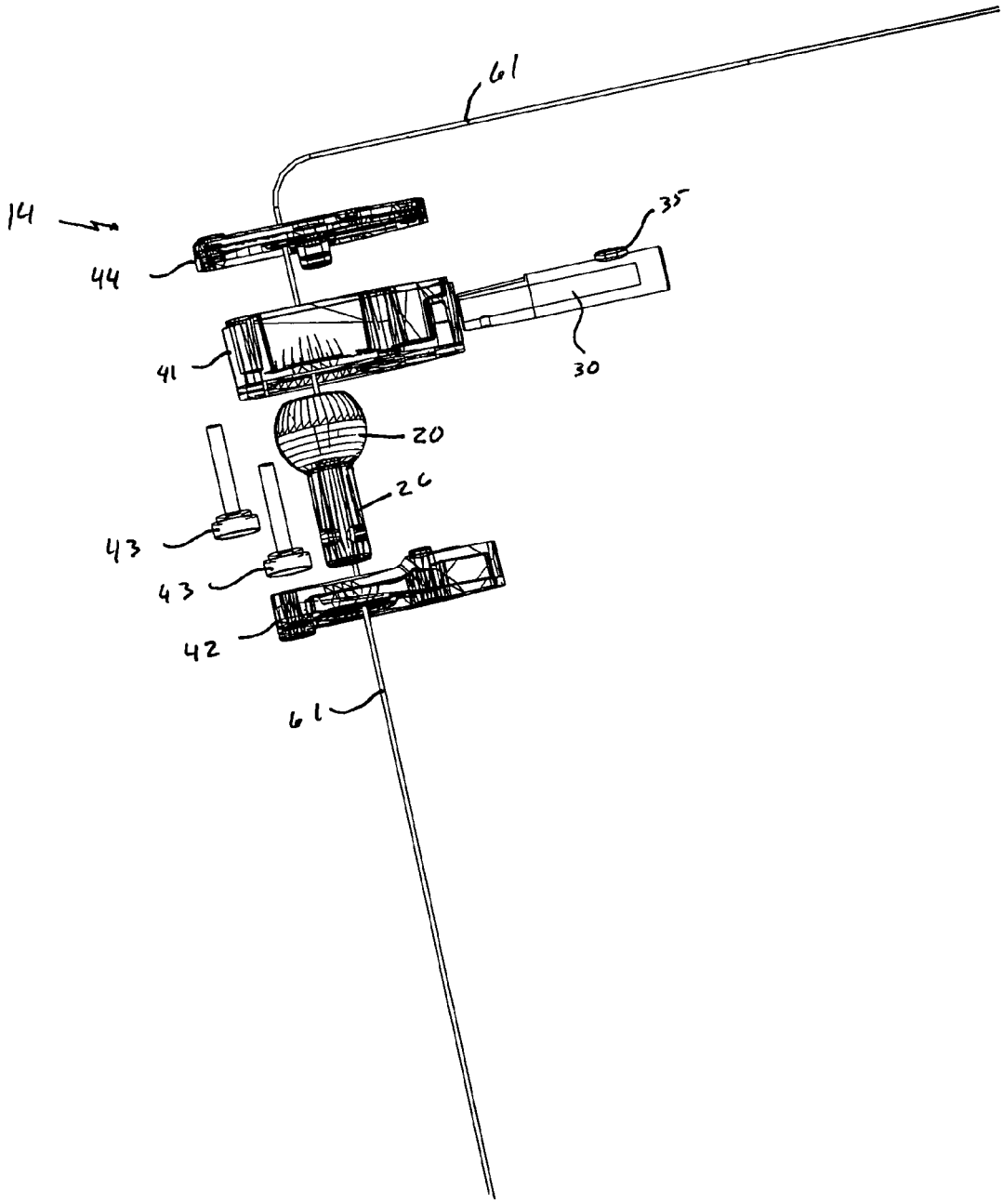
FIG. 14 shows an assembly view of the head of the apparatus.

FIG. 14 shows an assembly view of the head 14 of the apparatus 10. As shown in FIG. 14, the ball 20 is positioned between the lower portion 42 and the mid-portion 41 of the head 14. Tensioning screws 43 connect the lower portion 42 to the mid-portion 41. Also in this embodiment, a string 61 passes through the head 14, including through the ball 20 to control the brake arrangement 80. The male connector 30 is generally cylindrical in this embodiment and includes a key 35 to limit or prevent axial movement of the male portion 30 relative to the female connector 31.

Figure 15:
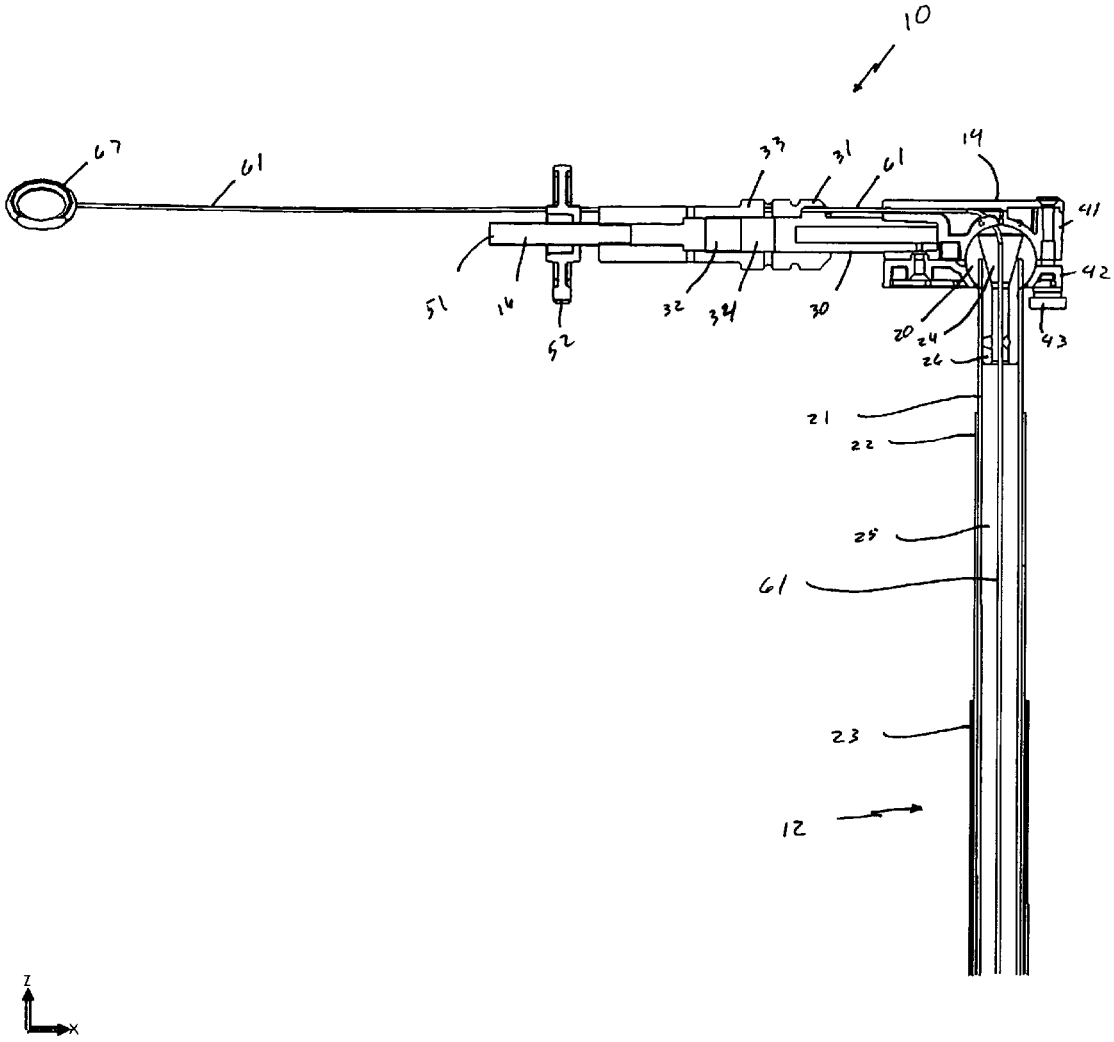
FIG. 15 shows a cross-section view of the apparatus, shown in FIG. 11.
Figure 16:
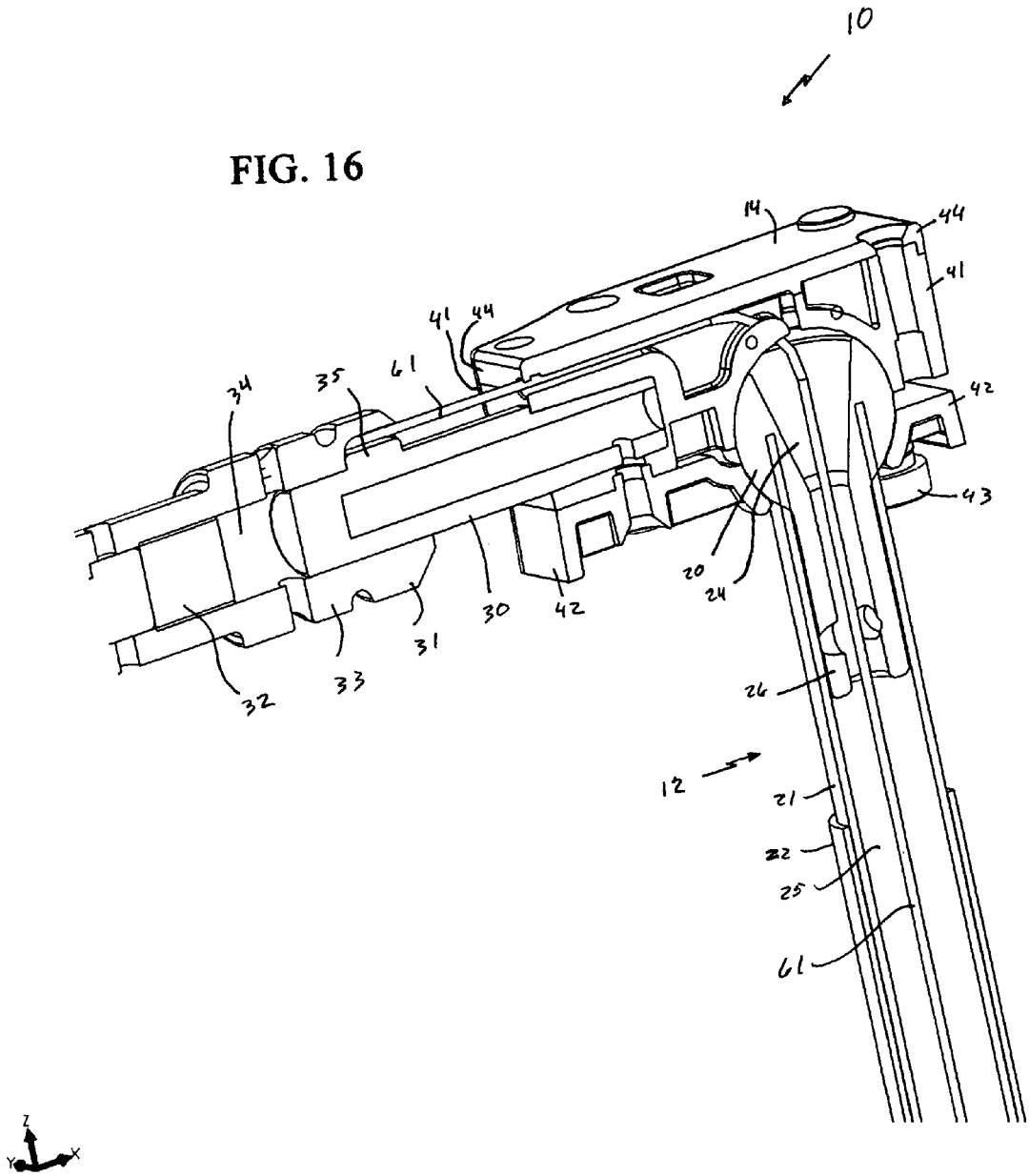
FIG. 16 shows a cut-away view of the head shown in FIG. 15.

FIG. 15 shows a cross-section view of the apparatus 10, shown in FIG. 11, including a string 61 that passes through the cavity 24 in the ball 20 and into the hollow portion 25 of the shaft 12. The string 16 controls the brake arrangement (not shown). The first end of the string 61 is connected to an O-ring 67 that is accessible to the user, outside the shaft 12 when the user is holding the bow (or other device connected to apparatus 10). The second end (not shown) of the string 61 connects to a brake release (not shown) disposed in the hollow portion 25 of the shaft 12. This allows the user to adjust the length of the shaft 12. FIG. 16 shows a more detailed cutaway view of the head 14 shown in FIG. 15. As shown, the string 61 passes through the cavity 24 of the ball 20.

FIG. 17 shows a cross-section of an exemplary embodiment of a brake arrangement 80 disposed within the hollow portion 25 of the shaft 12. In the embodiment shown, a conical plunger 64 is urged by a spring 65 toward a brake collet 60. The collet 60 acts as a brake by contacting the inner sidewall of the shaft 12 in response to pressure from the plunger 64. The spring 65 is contained in a housing 67. A brake release 62 is connected to the plunger 64 and moves the plunger 64 against the spring 65 to release the brake collet 60, to thereby allow the shaft 12 to adjust in length. In the embodiment of FIG. 14, the brake release 62 includes a hole 63 at an end. The string 61 or similar material is connected to the brake release 62 at the hole 63. The string 61 then passes upward through the hollow portion 25 of the shaft 12 to a point outside the shaft 12, where the string 61 may be accessed by the user to control the brake arrangement 80. In this embodiment, the brake arrangement 80 is normally in a locked position that fixes the length of the shaft 12. Tension on the string 61 urges the brake release 62 upward, against the spring 65, thereby moving the plunger 64 away from the brake collet 60 into a released position. A circular collet return spring 66 causes the collet 60 to move away from the interior wall of the shaft 12, thereby allowing the length of the shaft 12 to adjust.

Figure 18:
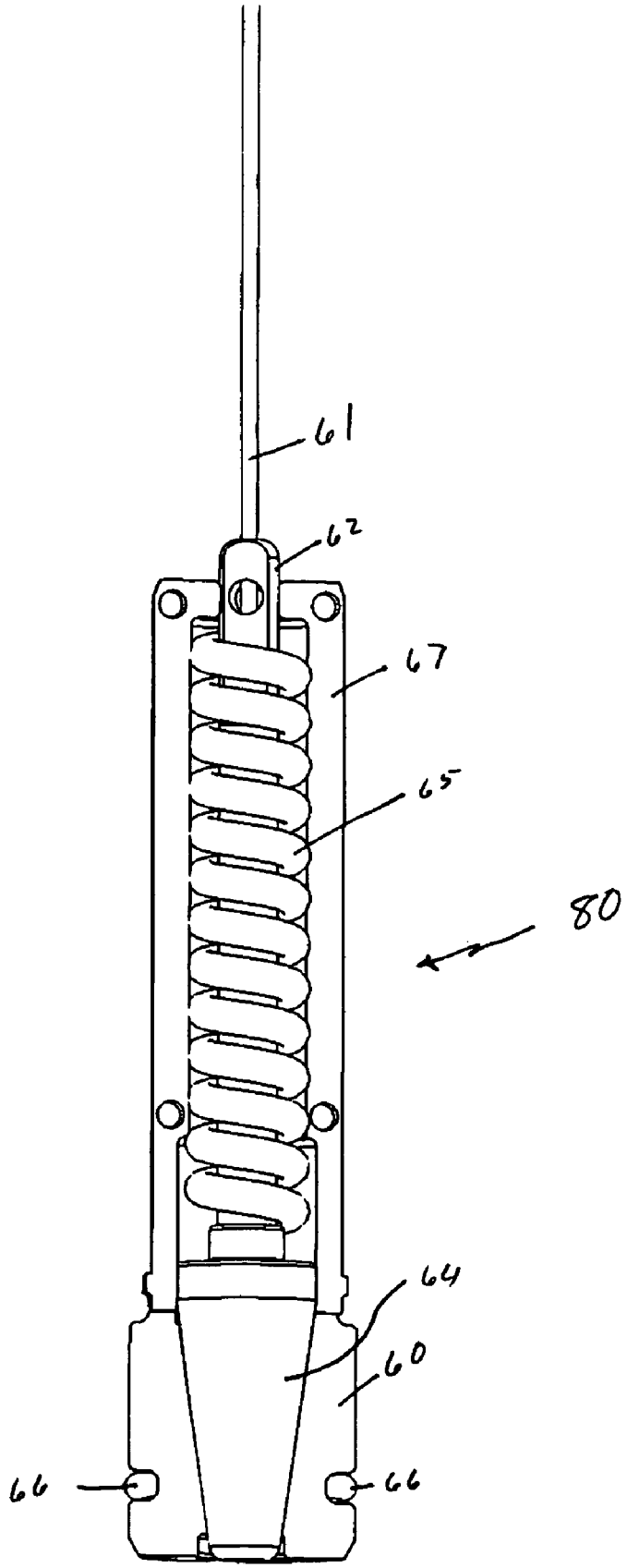
FIG. 18 shows a cut-away view of the brake arrangement of FIG. 17 in a released position.
Figure 19:
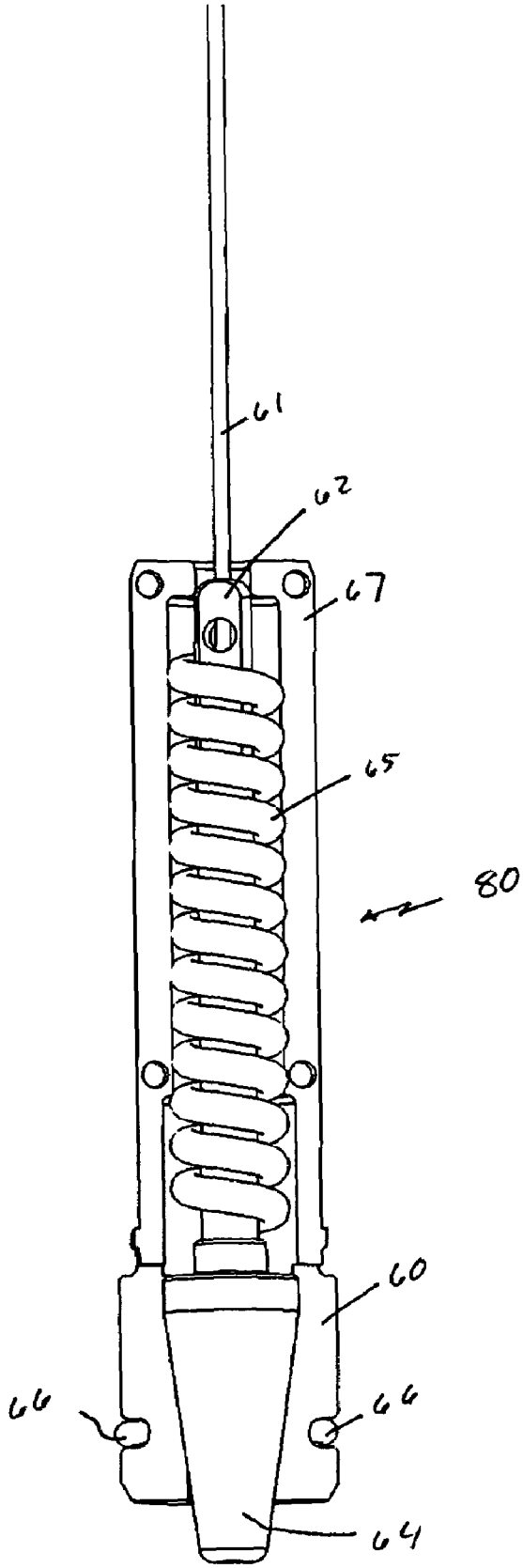
FIG. 19 shows a cut-away view of the brake arrangement of FIG. 18 in a locked position.

FIGS. 18 and 19 show more detailed, cut-away views of the brake arrangement 80. FIG. 18 shows the brake arrangement 80 in a released position in which tension has been placed on the string 61 to urge the plunger 64 upward in this orientation and to thereby allow the collet return spring 66 to urge the collet 60 inward, away from the inner wall of the shaft 12 (see FIG. 14). This allows the brake arrangement 80 to move relative to the shaft 12, to adjust the length of the shaft 12. FIG. 19 shows the brake arrangement 80 of FIG. 18, in a locked position. In response to lessened tension on the string 61, the spring 65 has urged the plunger 64 downward in this orientation. The plunger 64 then urges the collet 60 outward to contact the inner wall of the shaft 12. In so doing, the brake arrangement 80 prevents the telescoping shaft 12 from extending or retracting.

Figure 20:
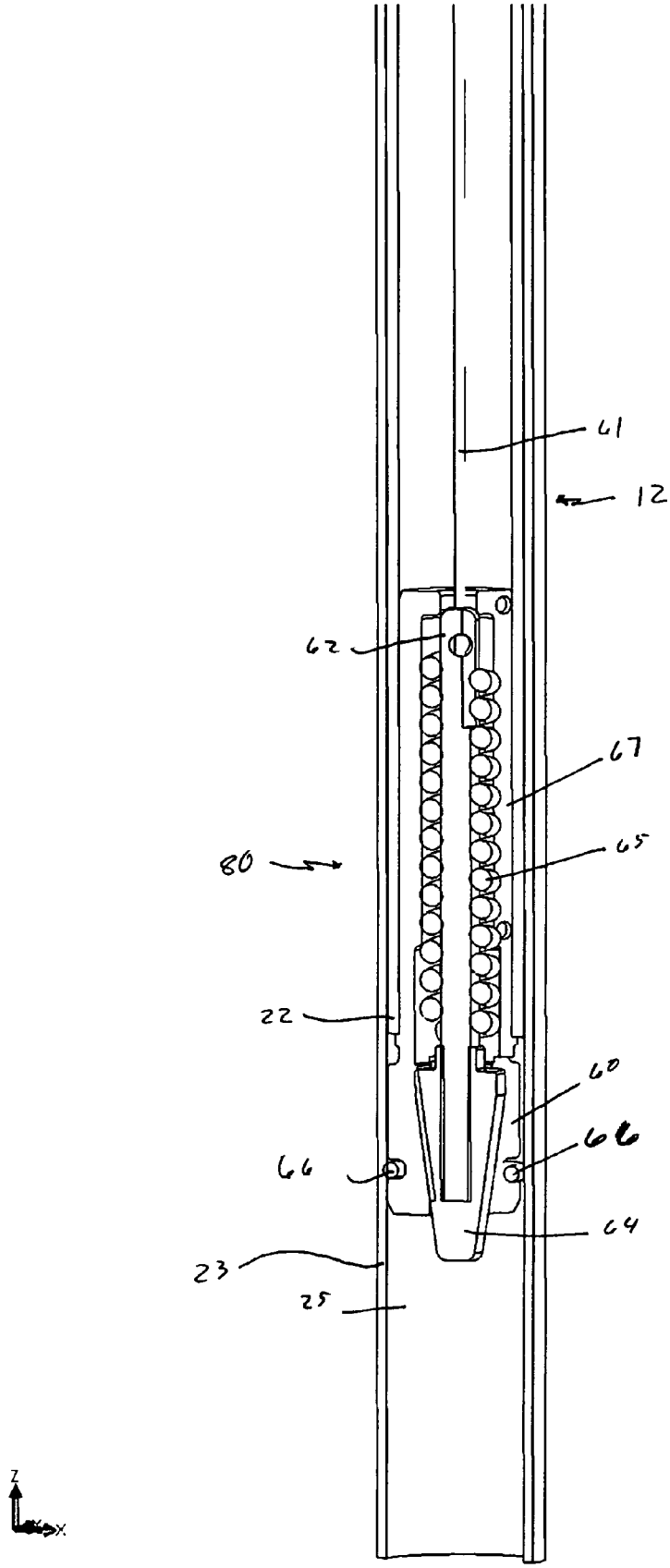
FIG. 20 shows a cross-section view of the brake arrangement of FIGS. 17-19 positioned within the shaft.

FIG. 20 shows a cross-section view of the brake arrangement 80 positioned within the shaft 12. In this embodiment, the housing 67 of the brake arrangement 80 is positioned near a lower end of the second portion 22 of the shaft 12. The collet 60 is positioned within the hollow portion 25 of the shaft 12, adjacent to the interior wall of the third portion 23 of the shaft 12.

Figure 21:
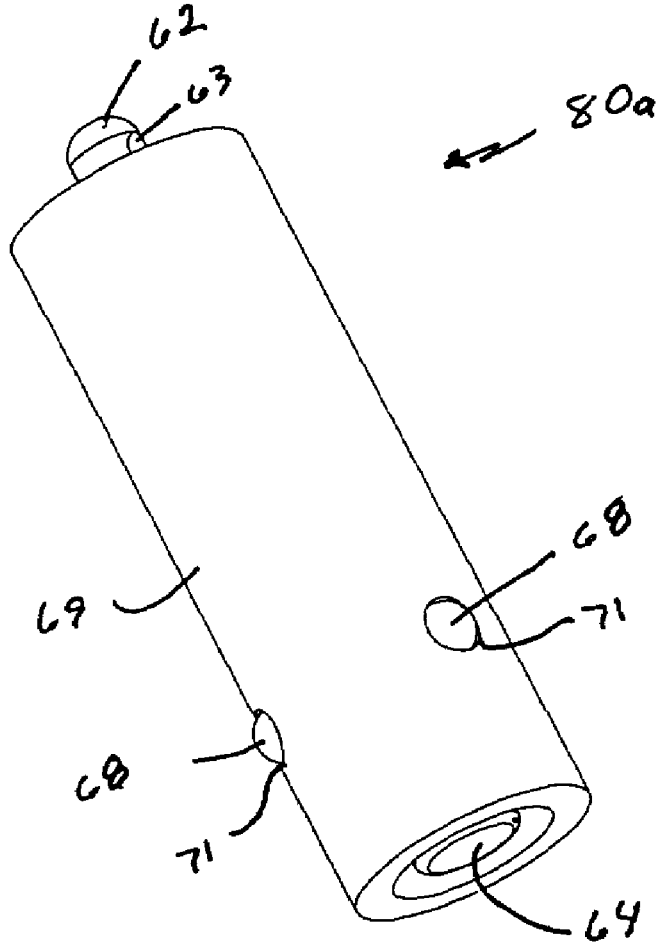
FIG. 21 shows an alternative embodiment of a brake arrangement.

FIG. 21 shows an alternative embodiment of a brake arrangement 80*a*. The embodiment of FIG. 21 uses balls 68 disposed within the housing 69 and in contact with the plunger 64. As the plunger 64 moves down (in this orientation), the balls 68 move outward through holes 71 in the housing 69 and contact the inner wall of the shaft 12, acting as a brake.

Figure 22:
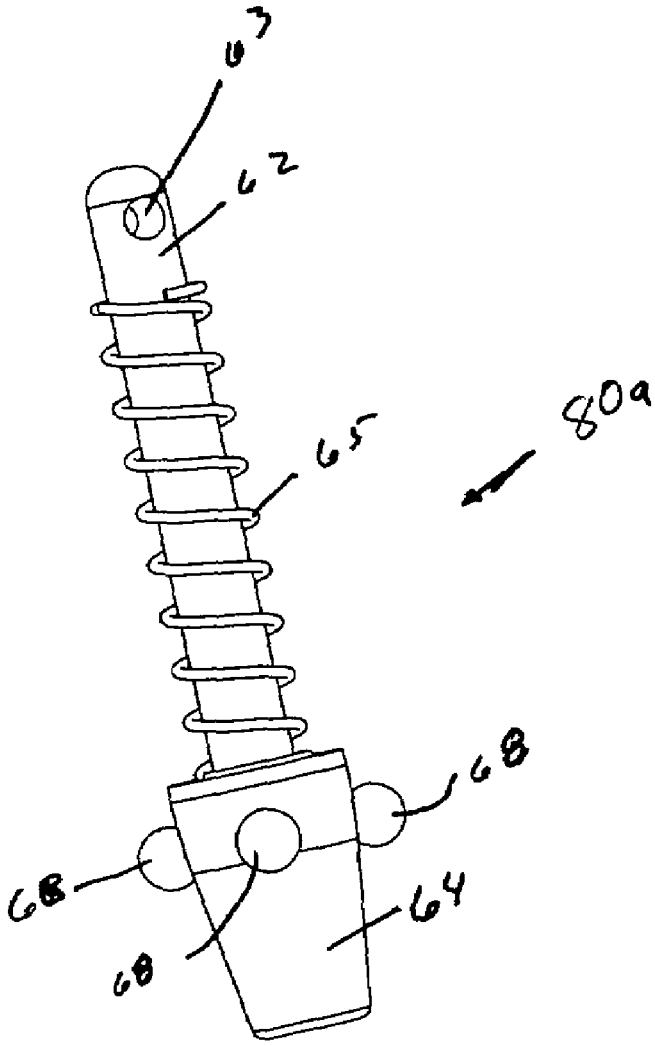
FIG. 22 shows the embodiment of the brake arrangement shown in FIG. 21, with the housing removed to illustrate interior details.

FIG. 22 shows the brake arrangement 80*a* of FIG. 21, with the housing 69 removed to illustrate interior details. As with the embodiment of the brake arrangement 80 shown in FIGS. 17-20, the embodiment of the brake arrangement 80*a* shown in FIG. 22 includes a brake release 62 connected to a plunger 64. A spring 65 urges the brake arrangement 80*a* into a locked position. As the plunger 64 moves downward (in this orientation), the balls 68 move outward through holes (71 in FIG. 20) in the housing (69 in FIG. 21) and thereby contact the inner wall of the shaft 12 to control the position of the shaft 12. To release the shaft 12, the brake release 62 is urged upward (in this orientation), for example, by using a string or other device attached to the hole 63 of the brake release 62, and the balls 68 then move in, away from the inner wall of the shaft 12.

Figure 23:
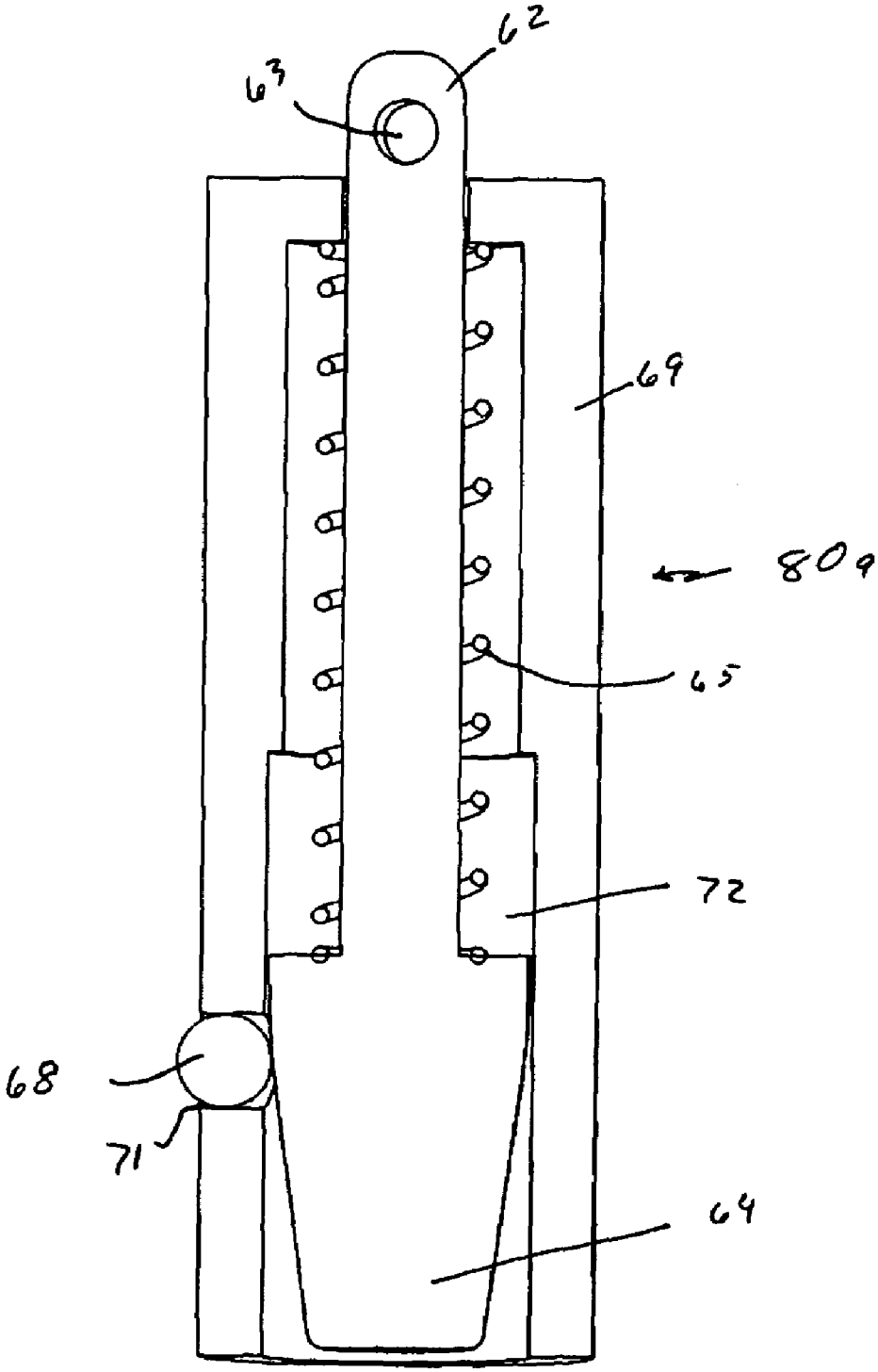
FIG. 23 shows a cross-section view of the brake arrangement shown in FIGS. 21 and 22 in a locked position.

FIG. 23 shows a cross-section view of the brake arrangement 80*a* shown in FIGS. 21 and 22, in a locked position. In the embodiment of FIG. 23, the brake arrangement 80*a* is in a locked position, in which the ball 68 is urged outward from the housing 69 through the hole 71 by the plunger 64. The plunger 64 moves laterally within a cavity 72 of the housing 69.

Figure 24:
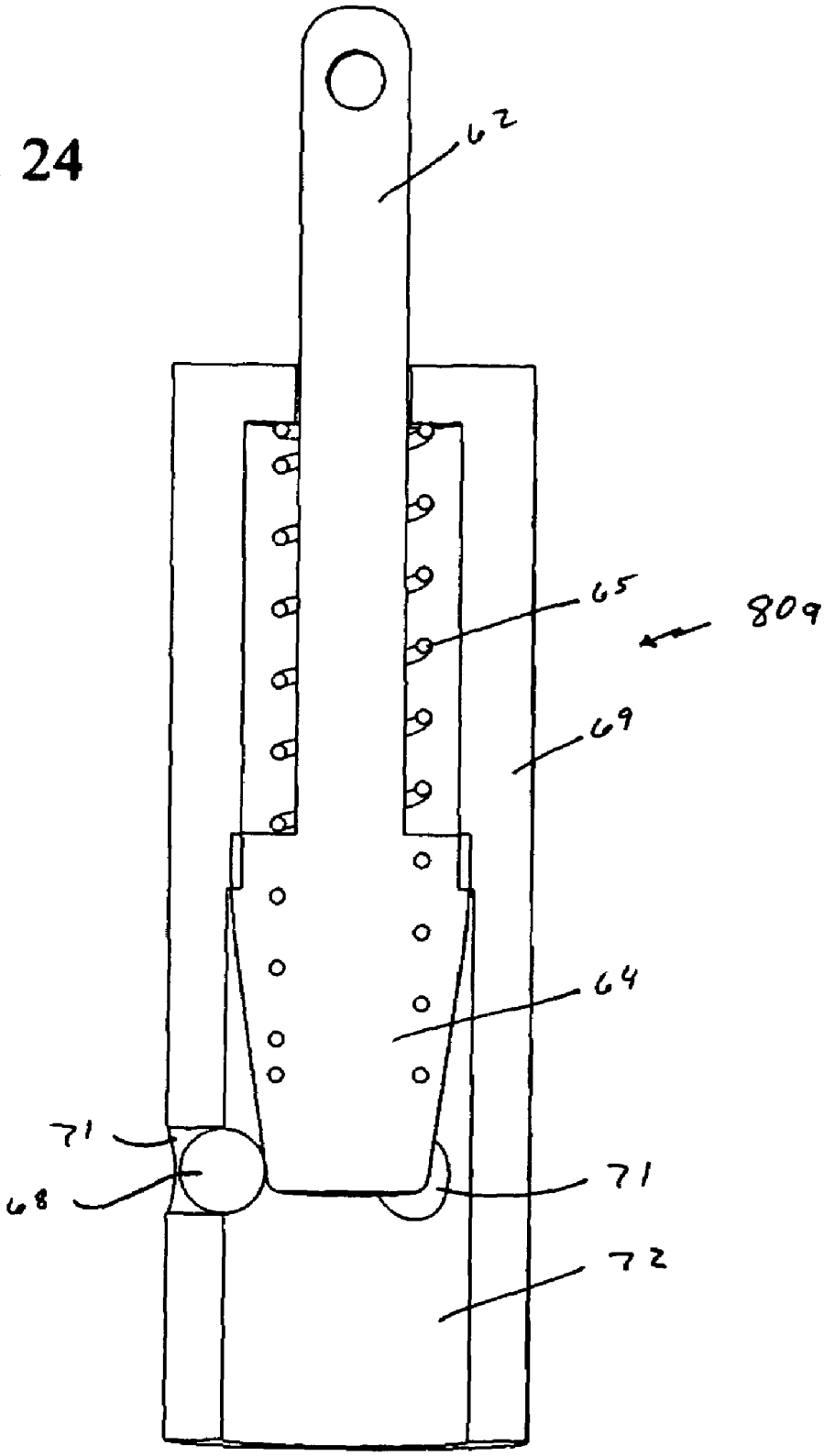
FIG. 24 shows a cross-section view of the brake arrangement shown in FIG. 23, in a released position.

FIG. 24 shows a cross-section view of the brake arrangement 80*a* shown in FIG. 23, in a released position. The plunger 64 has moved upward within the cavity 72 of the housing 69. The ball 68 has moved inward relative to the housing 69, through the hole 71.

Figure 25:
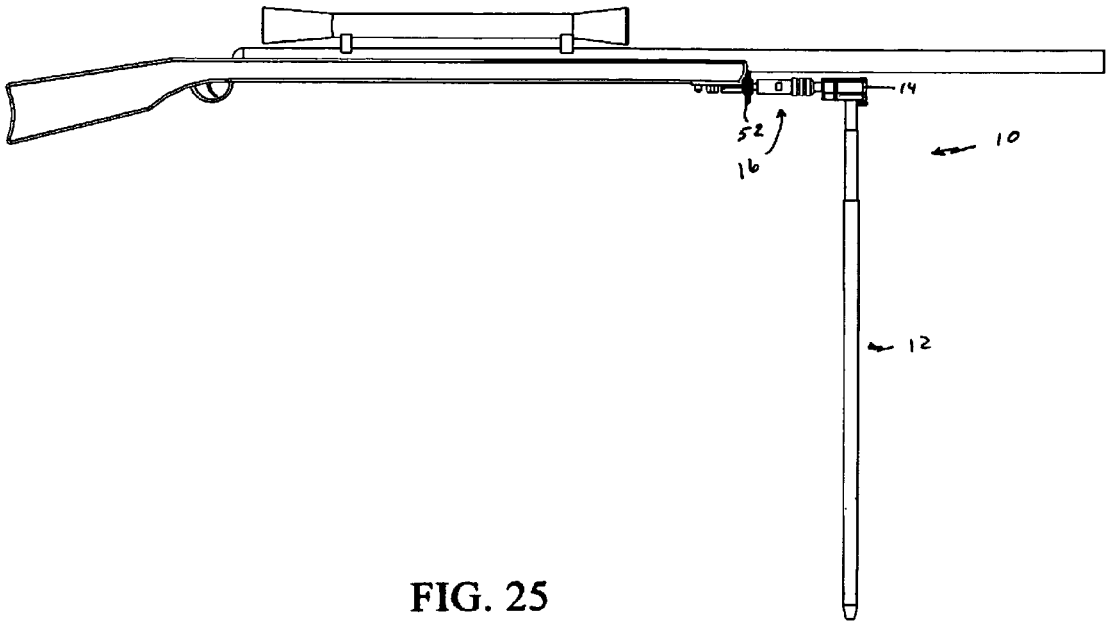
FIG. 25 shows a perspective view of the apparatus in use with a gun.
Figure 26:
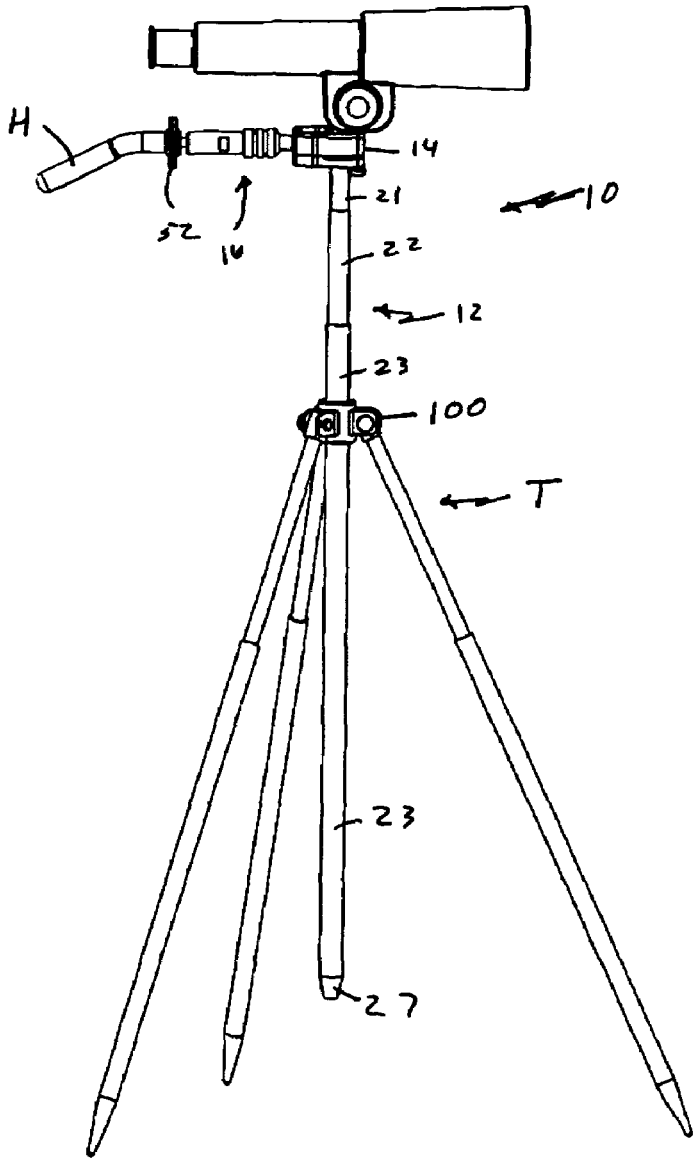
FIG. 26 shows a perspective view of the apparatus in use with a spotting scope.
Figure 27:
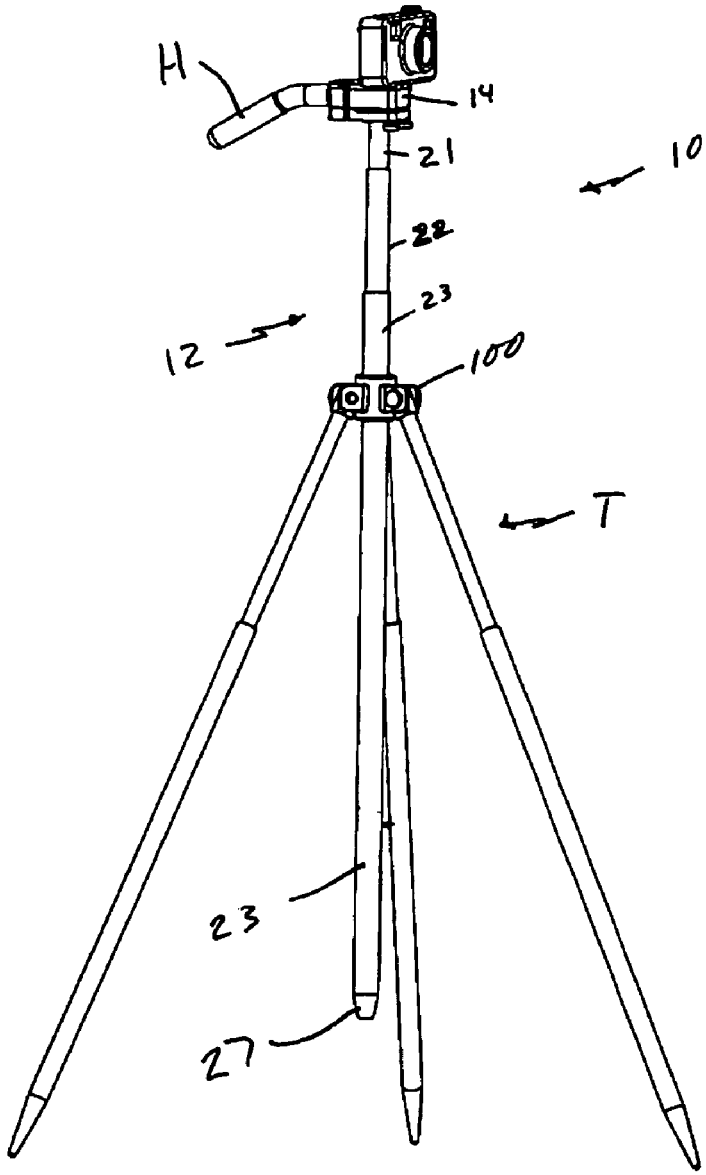
FIG. 27 shows a perspective view of the apparatus in use with a camera.

Although the apparatus 10 has been described with respect to particular embodiments showing its use in connection with archery bows, one skilled in the art will recognize that the apparatus may be used to support any number of different devices. By way of example, FIG. 25 shows a perspective view of the apparatus 10 in use with a gun. In this embodiment, the connection end 16 connects to the stock of the gun and locks using a lock mechanism 52. As another example, FIG. 26 shows a perspective view of the apparatus 10 in use in connection with a spotting scope. In this example, the scope attaches to the head 14 of the apparatus 10, and a handle H attaches to the connection end 16 of the apparatus 10 to facilitate movement of the scope. In the example of FIG. 24, the shaft 12 is used in connection with a tripod T. The tripod T includes a collar 100 that secures the shaft 12 in use. As yet another example, FIG. 27 shows a perspective view of the apparatus 10 used in connection with a camera, also with the tripod T. Also in this embodiment, a handle H connects to the connection end 16 of the apparatus 10 and the camera connects to the head 14, as with the spotting scope in FIG. 26. If desired, the apparatus 10 may be used in connection with an archery bow and may also use a tripod T as shown in these examples, for example, to sight the bow or to assist new, disabled, or elderly users.

Figure 28:
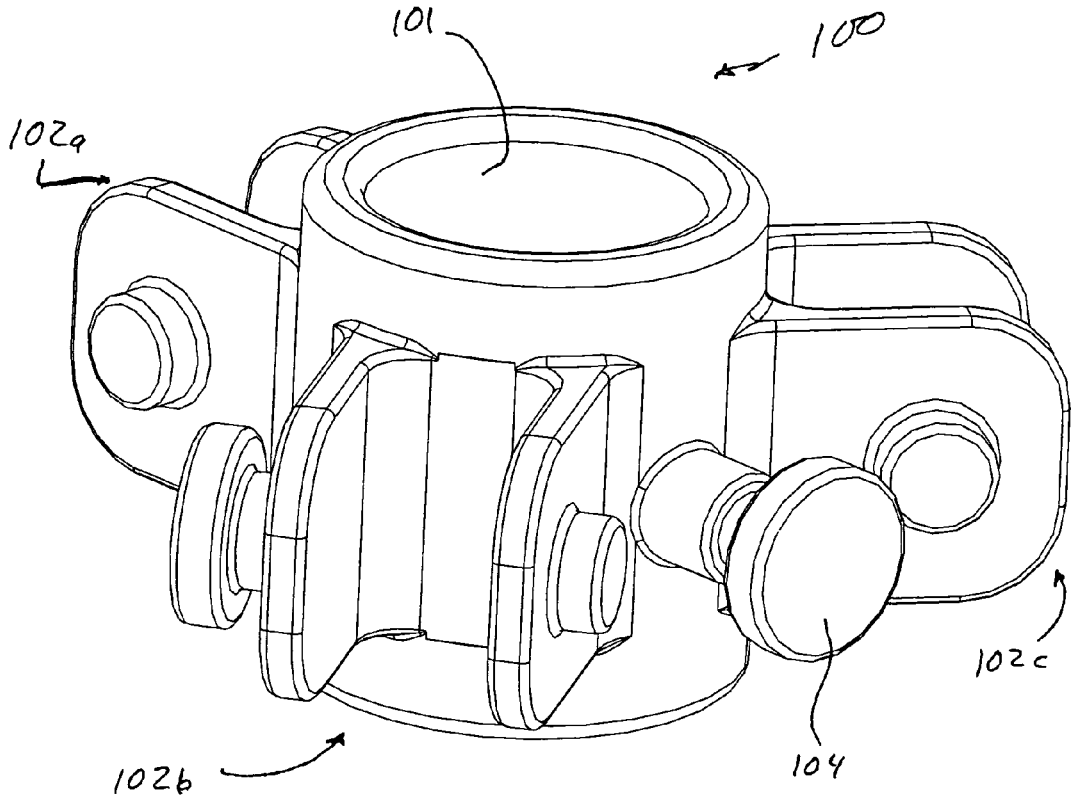
FIG. 28 shows a more detailed view of one embodiment of the collar used in connection with the tripod in FIGS. 25-27.

FIG. 28 shows a more detailed view of one embodiment of the collar 100 used in connection with the tripod T in FIGS. 25-27. In this embodiment, the collar 100 includes a shaft receiving portion 101 with a lock 104 that holds the collar 100 in place relative to the shaft 12. The collar 100 also includes three leg connectors 102*a*, 102*b*, 102*c*.

Figure 29:
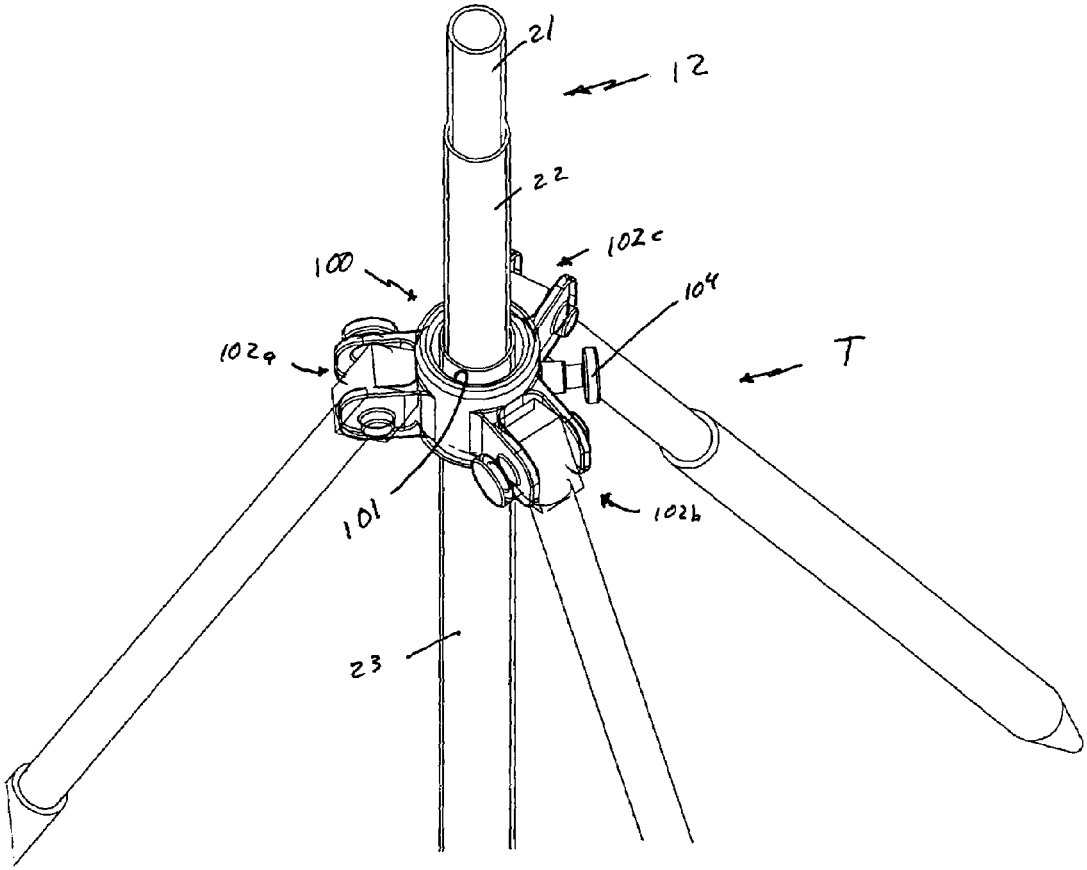
FIG. 29 shows the collar in use with a shaft of the apparatus.

FIG. 29 shows the collar 100 in use with a shaft 12 of the apparatus 10. As shown, the leg connectors 102*a*, 102*b*, 102*c* each connect to separate legs of the tripod T. The shaft 12 passes through the shaft receiving portion 101 of the collar 100. The lock 104 holds the shaft 12 in position relative to the collar 100.

Although the present invention has been described with respect to particular embodiments thereof, variations are possible. The present invention may be embodied in specific forms without departing from the essential spirit or attributes thereof. It is desired that the embodiments described herein be considered in all respects illustrative and not restrictive and that reference be made to the appended claims and their equivalents for determining the scope of the invention.

What is claimed is:

1. An apparatus comprising:

a telescoping shaft;

a brake arrangement that selectively extends the shaft to a pre-determined length;

a brake control that operates the brake arrangement said brake control comprising a string;

a head connected to the shaft to allow pivoting movement between the shaft and the head at a joint in a range of 360 degrees; and a bow connector capable of connecting the head to a supported object.

2. The apparatus of claim 1, wherein the supported object is selected from the group consisting of an archery bow, a firearm, a camera, a spotting scope, a range-finder, a transit, and a set of binoculars.

3. The apparatus of claim 1, wherein the bow connector is a connector adapted to connect to a universal connector of a riser section of the archery bow.

4. The apparatus of claim 1, wherein the joint comprises a ball joint, and further comprising a control that selectively allows movement between the head and the shaft at the ball joint.

5. The apparatus of claim 1, wherein the brake arrangement comprises:

a brake that limits extension of the shaft; and a brake release that releases the brake.

6. The apparatus of claim 1, wherein the shaft has an inner wall that defines a hollow portion, and wherein the brake is positioned within the hollow portion and contacts the inner wall when the brake arrangement is in a locked position.

7. The apparatus of claim 1, wherein the string has first and second ends, wherein the first end is attached to the brake release and wherein the second end is accessible from outside of the shaft.

8. The apparatus of claim 1, wherein the head is pivotally connected to the bow connector to allow axial movement of the head relative to the bow connector about an axis therebetween.

9. The apparatus of claim 8, wherein the head releaseably connects to the bow connector.

10. The apparatus of claim 8, wherein the head is pivotally connected to the bow connector at a releasable connection comprising:

a male portion;

a female portion that receives the male portion; and a magnet that couples the male portion to the female portion.

11. An apparatus comprising:

a bow connector comprising a first end that is adapted to connect to a universal connector of an archery bow, and a damper that dampens vibration from the bow;

a head releaseably connected to the bow connector at a magnetic connection; and a shaft depending from the head.

12. The apparatus of claim 11, wherein the shaft is connected to the head portion at a ball joint.

13. The apparatus of claim 11, wherein the shaft has an adjustable length and further comprises a brake arrangement that controls the extension of the length.

14. The apparatus of claim 13, wherein the brake arrangement comprises a brake that limits adjustment of the length and a brake control that is accessible to a user of an archery bow connected to the apparatus at the bow connector.

15. A support apparatus comprising:

means for supporting a supported object;

means for connecting to the supported object;

means for releaseably connecting the means for supporting to the means for connecting to the supported object; and means for extending to a pre-determined length the means for supporting, comprises means for braking the means for extending in order to control the means for extending; wherein the means for braking comprises a string.

16. The apparatus of claim 15, further comprising means for allowing rotational movement between the supporting means and the means for releaseably connecting to the supporting object.

17. The apparatus of claim 15, further comprising means for dampening at least one of vibration and noise from the supported object, wherein the dampening means is connected to the means for connecting to the supported object.

18. An apparatus for controlling extension of a telescoping shaft, the apparatus comprising:

a brake arrangement comprising:

a brake collet adapted to fit within a shaft;

a spring that urges the brake collet into contact with the shaft to limit movement of the shaft; and a brake release that releases the collet from contact with the shaft to allow movement of the shaft wherein the brake release comprises a string.

19. The apparatus of claim 18, wherein the brake arrangement further comprises a collet return spring that urges the collet away from the shaft.

20. The apparatus of claim 18, wherein the brake arrangement further comprises a plunger connected to the brake release, wherein the spring urges the plunger toward the collet to contact the shaft and wherein the brake release allows movement of the plunger away from the collet to urge the collet away from the shaft.

21. The apparatus of claim 20, further comprising a wire connected to the brake release, wherein the wire may be used to control the brake release.

22. The apparatus of claim 21, further comprising the shaft and wherein the brake arrangement is disposed within the shaft.

23. An apparatus comprising:

a shaft;

a head connected to the shaft to allow pivoting movement between the shaft and the head at a joint in a range of 360 degrees; and a supported-object connector capable of connecting the head to a supported object, wherein the head is pivotally connected to the supported-object connector at a releasable connection to allow axial movement of the head relative to the bow connector about an axis therebetween, the releaseable connection comprising a male portion;

a female portion that receives the male portion; and a magnet that couples the male portion to the female portion.

24. The apparatus of claim 23, wherein the supported object is selected from the group consisting of an archery bow, a firearm, a camera, a spotting scope, a range-finder, a transit, and a set of binoculars.

25. The apparatus of claim 23, wherein the bow connector is a connector adapted to connect to a universal connector of a riser section of the archery bow.

26. The apparatus of claim 23, wherein the joint comprises a ball joint, and further comprising a control that selectively allows movement between the head and the shaft at the ball joint.

27. The apparatus of claim 23, further comprising:

a brake arrangement that selectively extends the shaft to a pre-determined length; and a brake control that operates the brake arrangement.

* * * * *